US010286294B1

(12) United States Patent
Bierly

(10) Patent No.: US 10,286,294 B1
(45) **Date of Patent: *May 14, 2019**

(54) COMPETITIVE GAME WITH SPINNING GAME WHEEL AND PLAYING PIECES

(71) Applicant: Craig Joseph Bierly, Port Deposit, MD (US)

(72) Inventor: Craig Joseph Bierly, Port Deposit, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,839

(22) Filed: Sep. 12, 2016

Related U.S. Application Data

(63) Continuation-in-part of application No. 14/335,208, filed on Jul. 18, 2014, now Pat. No. 9,440,141.

(60) Provisional application No. 61/856,838, filed on Jul. 22, 2013.

(51) Int. Cl.
*A63F 3/00* (2006.01)
*A63F 5/02* (2006.01)

(52) U.S. Cl.
CPC ..... *A63F 3/00261* (2013.01); *A63F 3/00157* (2013.01); *A63F 3/00895* (2013.01); *A63F 5/02* (2013.01); *A63F 2003/00268* (2013.01)

(58) Field of Classification Search
CPC ..... A63F 3/00261; A63F 3/00895; A63F 2003/00268; A63F 3/00157; A63F 3/02
USPC ..... 273/440, 441, 443, 444, 447, 280, 139, 273/138.1
See application file for complete search history.

(56) References Cited

U.S. PATENT DOCUMENTS

| | | | | | |
|---|---|---|---|---|---|
| 728,327 | A | * | 5/1903 | Tanron | A63F 7/027 273/119 A |
| 1,427,135 | A | | 8/1922 | Tenney | |
| 1,492,976 | A | | 7/1924 | Gill | |
| 2,193,896 | A | | 3/1940 | Angst | |
| 2,721,082 | A | * | 10/1955 | Hunold | A63F 5/0088 273/142 F |
| 2,831,692 | A | | 4/1958 | Keast | |
| 2,839,303 | A | | 6/1958 | Baker | |
| 3,203,699 | A | * | 8/1965 | Pearson, Jr. | A63F 5/02 273/119 A |
| 3,643,954 | A | * | 2/1972 | Meyer | A63F 9/02 273/119 A |
| 3,762,714 | A | | 10/1973 | Wilson | |
| 3,840,235 | A | | 10/1974 | Breslow | |

(Continued)

*Primary Examiner* — Vishu K Mendiratta
(74) *Attorney, Agent, or Firm* — Invention To Patent Services; Alex Hobson

(57) ABSTRACT

A competitive table game includes a rapidly spinning game wheel, an annular collection area, a base, and a plurality of rollable playing pieces. The game wheel is rotatably connected onto the base while the annular collection area is concentrically positioned around the game wheel. During each game, the players roll the plurality of rollable playing pieces on a smooth top surface of the game wheel as the plurality of rollable playing pieces is tangentially positioned on the smooth top surface and released attempting to match the linear velocity at the respective position on the game wheel. Then the plurality of rollable playing pieces moves across the smooth top surface and drops into the annular collection area, where the winner of each game is determined according to the game rules of each different game and the positioning of the plurality of rollable playing pieces. Other embodiments are described and shown.

15 Claims, 21 Drawing Sheets

(56) References Cited

U.S. PATENT DOCUMENTS

| | | | | | |
|---|---|---|---|---|---|
| 4,022,474 | A * | 5/1977 | Breslow | A63F 5/04 | 273/138.2 |
| 4,061,334 | A * | 12/1977 | Kanno | A63F 9/02 | 273/109 |
| 4,253,669 | A * | 3/1981 | Ferris | A63F 5/02 | 273/340 |
| 4,549,737 | A | 10/1985 | Seyer | | |
| 4,928,968 | A * | 5/1990 | Gebert | A63F 9/16 | 273/353 |
| 5,201,524 | A | 4/1993 | Csanady et al. | | |
| 5,458,342 | A | 10/1995 | Henandex | | |
| 5,564,697 | A * | 10/1996 | Catrinar | A63F 7/0023 | 273/119 R |
| 6,540,229 | B1 | 4/2003 | Smith et al. | | |
| 9,440,141 | B2 * | 9/2016 | Bierly | A63F 3/00261 | |
| 2008/0054569 | A1 | 3/2008 | Medina | | |

* cited by examiner

COMPETITIVE GAME WITH SPINNING GAME WHEEL AND PLAYING PIECES

CROSS REFERENCE TO RELATED APPLICATIONS

This application is a continuation in part of U.S. patent application Ser. No. 14/335,208, filed on Jul. 18, 2014, entitled Competitive Game with Spinning Game Wheel and Playing Pieces, which is currently pending and which claims the benefit of U.S. provisional patent application 61/856,838 filed on Jul. 22, 2013; the entirety of both are hereby incorporated by reference herein.

BACKGROUND OF THE INVENTION

Field of the Invention

The present invention relates generally to a single or multi-player table game. More specifically, the present invention is completed with a manual or powered round horizontal spinning game wheel, playing pieces, and a stationary or rotating collection area for the playing pieces to fall into as the collection area also serves as a method of scoring or point multiplier for the games

Background

There are several games of chance that exist (such as roulette and big six wheel). There are several games that require a considerable level of skill or technique (such as bowling, ping pong, horseshoes, billiards or shuffleboard). There are several games that involve dueling game pieces and multi-player competition, and several games that involve some level of entertainment from motion/movement. The present invention relates to game devices and more particularly is directed to a new game that requires exercise of considerable skill as well as luck and utilizes a rapidly spinning flat game wheel and playing pieces. The present invention is a table game that combines skill, luck, and physics in a fun and entertaining manner as the present invention can be played in bars, billiard rooms, college campuses, outdoor (such as backyard or patios), family living rooms, casinos, and any other similar places. The present invention is intended to be played by families and friends, including young and older children, and adults where the present invention provides a competitive and fun game environment for all the players. In several embodiments, the present invention can be affordably manufactured and occupies considerably less space compared to the other game room style games such as billiards or shuffleboard. There are three general stages of play with the present invention as the present invention can be utilized within many different games:

SUMMARY OF THE INVENTION

The invention is directed to a competitive game that has a spinning game wheel and a plurality of game pieces that roll along the game wheel and into a collection area configured around the game wheel. The playing pieces are disc shaped having a round outer perimeter and roll on their edge. In an exemplary embodiment the playing pieces are coin shaped, having substantially parallel sides and a flat edge. A plurality of playing pieces may be released onto the spinning game wheel at about the same time and the last game piece to roll off of the game wheel and into the collection area may be the winner or receive an associated point value for being the last playing piece on the wheel.

Launch—All players roll their playing pieces onto the rapidly spinning game wheel. Players that do not have a good roll technique (spin rate, angle, etc.) find their playing piece immediately roll off from the game wheel into the collection area. For novice players, rolling aids can be incorporated to launch the game pieces onto the spinning wheel. As player skills improve, different techniques can be utilized to launch the game pieces onto the spinning game wheel depending on the game wheel rotational velocity and location on the game wheel that the game piece is launched. In a game table or casino version of the present invention, all playing pieces can be set into motion at once by a game operator.

Roll—Any playing pieces that are successfully launched with an acceptable roll technique will roll in an unpredictable fashion around the game wheel, losing speed towards the center of the game wheel and gaining speed towards the edge of the game wheel. The playing pieces can roll and bump into each other as the playing pieces may exit from the game wheel after contact.

Determining the winner—depending on the rules of each different game, the winner of the game is determined upon the positioning, a resting position, of the playing pieces with respect to the game wheel and/or the collection area, typically the player with the last game piece on the turntable will be awarded the points.

The collection area may be broken up into receptacles and these receptacles may have point weighted values. For example, the collection area may have small receptacles and large receptacles and the small receptacles may have a higher point value than the large receptacles, as it is less likely that a playing piece will land in the small receptacle. The small receptacle has a shorter are of entry from the game wheel than the large receptacle. In an exemplary embodiment, the collection area comprises small, intermediate and large receptacles. A collection area is configured around the game wheel, such as around a portion of the perimeter of the game wheel or all the way around the game wheel in a ring, or concentrically around the game wheel. The collection area may have receptacles that define point weighted sections completely around the game wheel or around a portion of the collection area. For example, receptacles defining positive point weighted sections may make up a portion of the collection area and there may be other receptacles that have no point weighted section, or are a zero-point weighted section. Receptacles may be evenly spaced around the perimeter of the game wheel.

A drive mechanism may be configured to spin the game wheel and may be located in the base of the game apparatus. In another embodiment, the collection area may be configured to spin in the same direction as the game wheel or in an opposing direction. In addition, the collection area may be configured to spin at the same speed as the game wheel or at an offset speed. It may be preferred to have the collection area spin at a lower speed to avoid game pieces jumping off the game top. A controller may be configured with a speed controller that can be used to adjust the spinning speed of the game wheel and/or the collection area. Separate controllers may be provided for the game wheel and the collection area, for example. The game wheel and or collection area may spin at any suitable controlled speed such as about 20 revolutions per minute (RPM) or more, about 60 RPM or more, about 120 RPM or more, about 180 RPM or more, about 360 RPM or more and any range between and including the spin rates provided. A controller may also be used to start and stop the spinning of the game wheel. In addition, count down lights or sounds may be used to indicate when a player is to release the playing piece onto the game wheel.

In an exemplary embodiment, a playing piece launch fixture is configured to launch a playing piece onto the game wheel. An exemplary playing piece launch fixture may be coupled with a controller and release the playing piece at a controlled time, such as in unison with all the other playing piece launch fixtures. In addition, an exemplary playing piece launch fixture may have an extended configuration and a retracted configuration. The playing piece launch fixture may extend out from a retracted position to enable the playing piece launch fixture to release or launch the playing piece onto the game wheel. After the playing piece has be released, the playing piece launch fixture may then retract so that it does not interfere with the playing pieces as the roll on the spinning wheel. A controller may control the functions of the playing piece launch fixtures.

An exemplary competitive game with a spinning wheel may be used for placing wagers on any number of outcomes of a game including, but not limited to, which receptacle a playing piece falls into, which playing piece will be the last playing piece to roll off of the spinning wheel or land on the spinning wheel and the like. The odds for the various outcomes may have different pay-out values or ratios as a function of the probability of that outcome.

Where there are discrepancies between this and any former application incorporated by reference herein, this application shall dominate.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
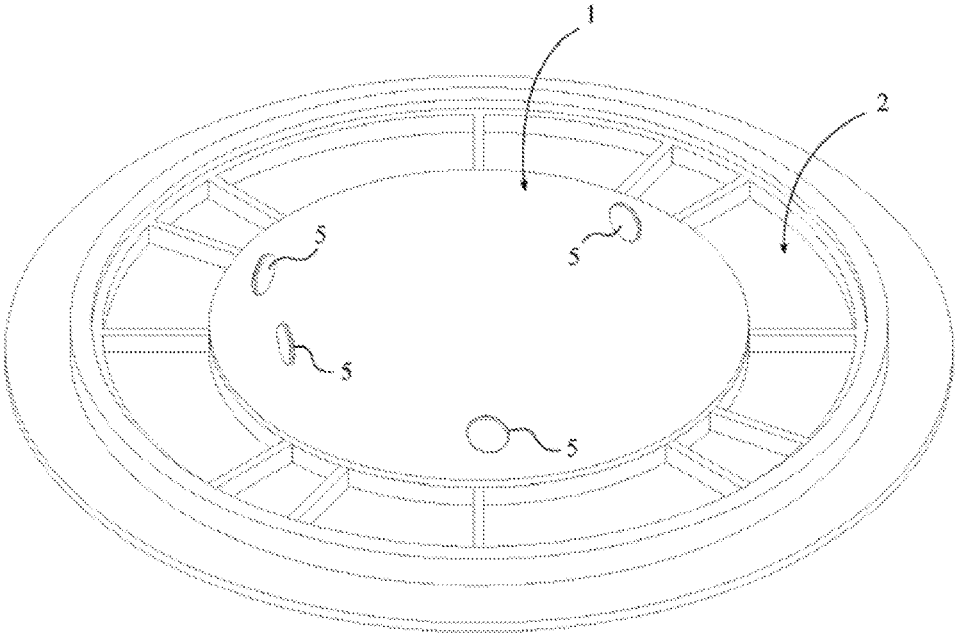
FIG. 1 is a perspective view of the first configuration for the preferred embodiment of the present invention.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

All illustrations of the drawings are for the purpose of describing selected versions of the present invention and are not intended to limit the scope of the present invention.

Figure 2:
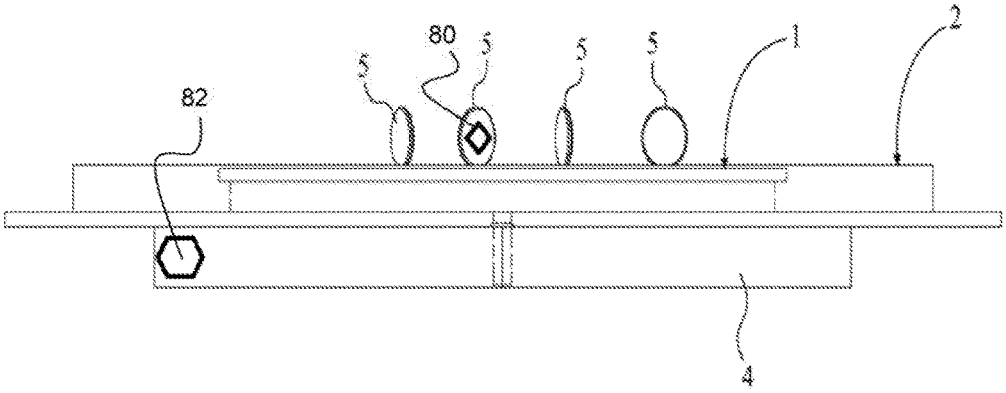
FIG. 2 is a side view of the first configuration for the preferred embodiment of the present invention.

The present invention is a competitive game apparatus that can be played by one, two, three, four, or more players. The present invention is configured into different embodiments so that the present invention can be utilized within different environments, such as homes, bars, casinos, billiard rooms, college campuses, outdoor (such as backyard or patios), family living rooms, and lounges. In order to attract a wider range of players and to improve the competitiveness of the present invention, a variety of games can be played within the present invention. In reference to FIG. 1 and FIG. 2, the present invention comprises a game wheel 1, an annular collection area 2, a base 4, and a plurality of rollable playing pieces 5. As for the general configuration of the present invention, the game wheel 1 is rotatably connected to the base 4 while the annular collection area 2 is either rotatably or stationarily connected to the base 4. Additionally, the annular collection area 2 is concentrically positioned around the game wheel 1 as the plurality of rollable playing pieces 5 is adapted to eccentrically move across the game wheel 1 and drop into the annular collection area 2. Also shown in FIG. 2 is a tracking device that is 80 that is coupled with the playing piece 5. A monitoring device 82 is configured to track the playing pieces to determine which playing piece is the last to roll off of the spinning game wheel 1. A monitoring device may comprise a microprocessor and/or may be coupled with a computing device and a display that displays which playing piece was the last to roll off the game wheel and/or which playing pieces came to rest on the game wheel.

Figure 4:
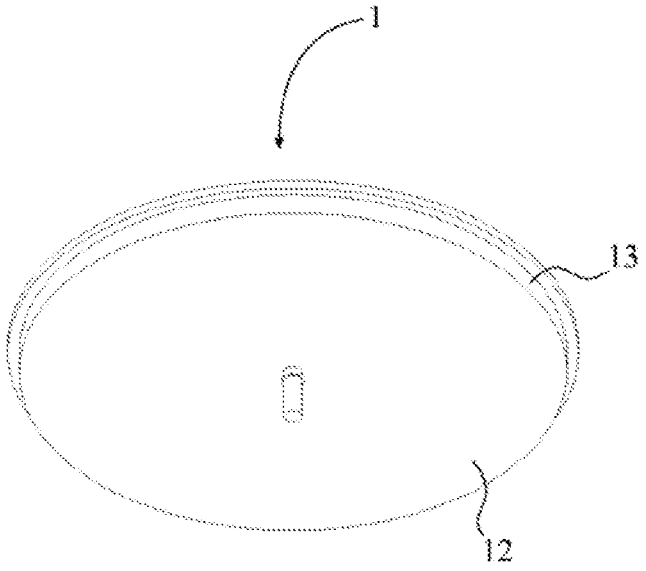
FIG. 4 is a bottom perspective view of the game wheel of the present invention.
Figure 5:
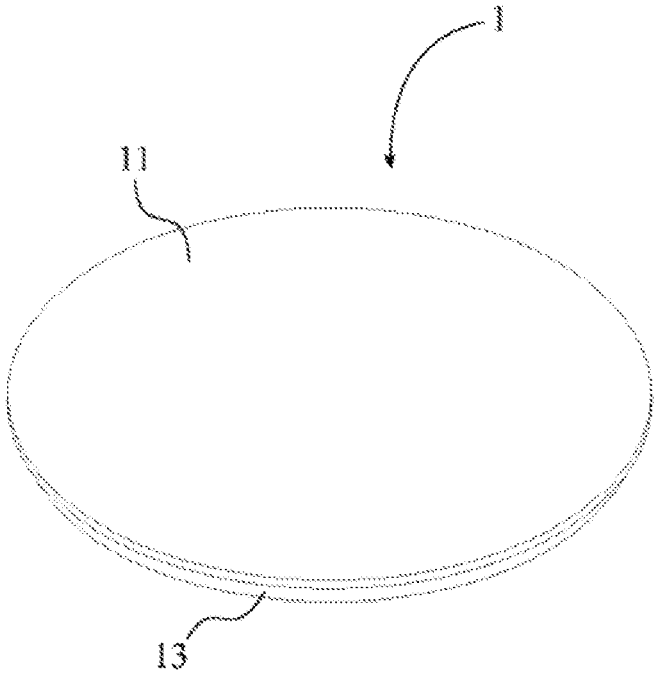
FIG. 5 is a top perspective view of the game wheel of the present invention.

The game wheel 1 provides the necessary surface area for the plurality of rollable playing pieces 5 to move within the present invention. The game wheel 1 can be preferably made from smooth or slightly textured and durable materials, such as plastic, composites, acrylic, resin, polycarbonate, wood, or any other type of similar material that can withstand the constant movement of the plurality of rollable playing pieces 5. In reference to FIG. 4 and FIG. 5, the game wheel 1 that is preferably shaped into a circular form comprises a smooth top surface 11, a bottom surface 12, and a lateral surface 13. More specifically, the smooth top surface 11 is oppositely positioned from the bottom surface 12 along the lateral surface 13, forming the game wheel 1. Additionally, the smooth top surface 11 and the bottom surface 12 are perpendicularly positioned with the lateral surface 13 so that the smooth top surface 11 and the bottom surface 12 are able to create parallel flat surfaces within the game wheel 1. The smooth top surface 11 may include slightly curved or angular profiles near the outer rim of the game wheel 1 to increase the spinning time of the plurality of rollable playing pieces 5. The smooth top surface 11 can include a small center ring for additional scoring of the present invention. For example, the small center ring may provide additional points if one of the plurality of rollable playing pieces 5 lands flat within the small center ring. The smooth top surface 11 can also include guide ring markings, where the guide ring markings create a competitive playing environment as the players are required to release the playing pieces in a similar radius of the game wheel 1 while matching the rotational velocity of the game wheel 1. The center of the game wheel 1 may include a cavity for game pieces to drop into, or as an insertion point for additional accessories of the present invention. For example, a stand can be positioned within the cavity or the insertion point to hold a magnet or sphere as they can affect the outcome of the game. The center of the game wheel 1 can also include at least one marked circle in order to expand the number of games that can be played on the present invention. The bottom surface 12 is adjacently positioned with the base 4 as the bottom surface 12 rotatably connects the game wheel 1 to the base 4. As a result, the smooth top surface 11 is able to provide the necessary surface area for the plurality of rollable playing pieces 5 so that the plurality of rollable playing pieces 5 can be rolled on the smooth top surface 11 according to the different games of the present invention. Lights or other visual or audible stimuli can be embedded in the game wheel or around the table for enhanced entertainment or to indicate to players when to roll their game pieces, thereby negating the need for players to verbally indicate when all players should roll their respective game pieces.

Figure 6:
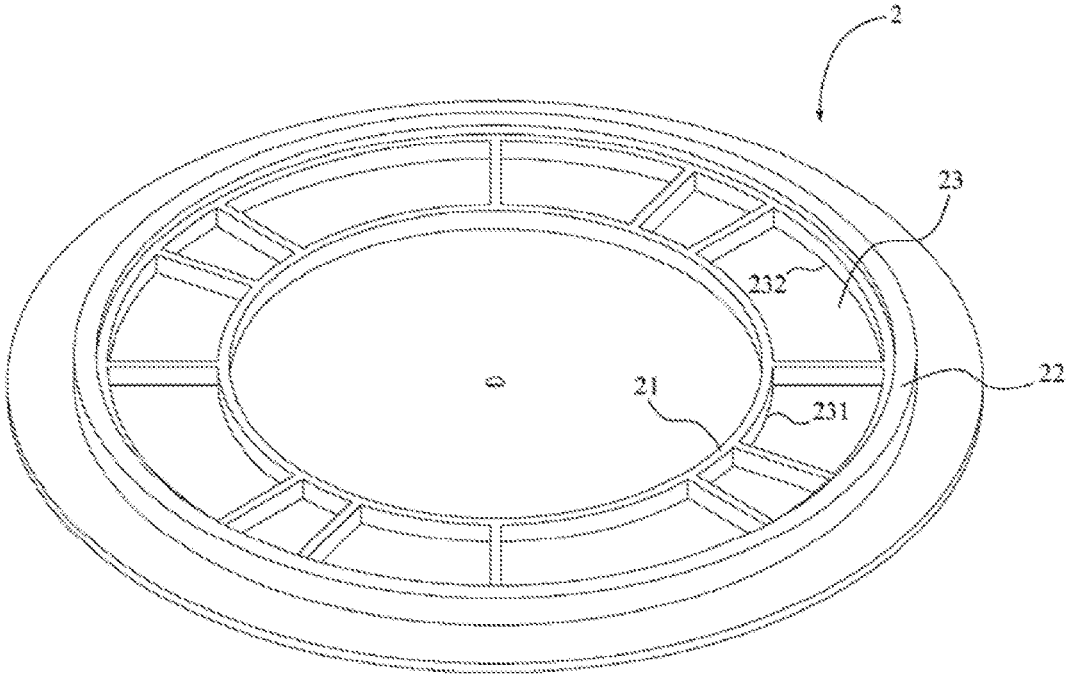
FIG. 6 is a perspective view of the annular collection area of the present invention.
Figure 7:
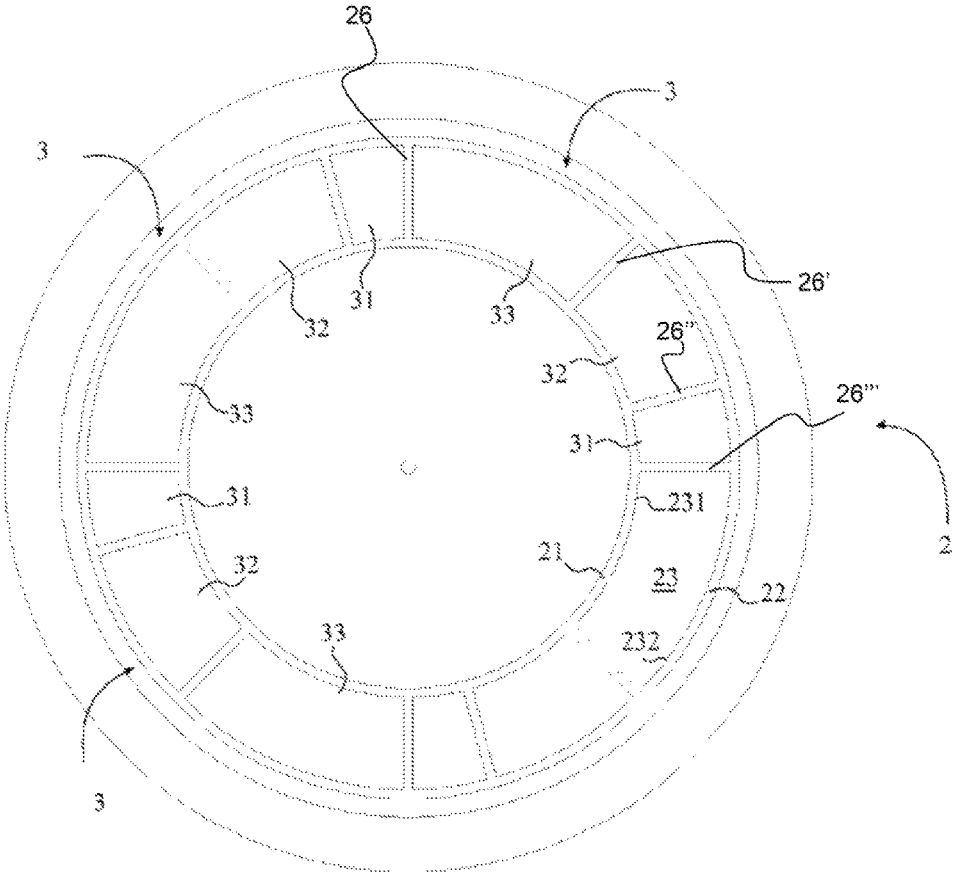
FIG. 7 is a top view of the annular collection area of the present invention.

In reference to FIG. 6 and FIG. 7, the annular collection area 2 determines the winning turn for some of the games and/or functions as a point multiplier as the plurality of rollable playing pieces 5 drops into the annular collection area 2. The annular collection area 2 comprises a first flange 21, a second flange 22, a landing base 23, and a plurality of point weighted sections 3. The first flange 21 is connected to an inner edge 231 of the landing base 23, and the second flange 22 is connected to an outer edge 232 of the landing base 23 in such a way that the first flange 21 and the second flange 22 are perpendicularly positioned with the landing base 23. Each of the plurality of point weighted sections 3 is evenly distributed around the annular collection area 2 in order to enhance the competitiveness of the games that are played on the present invention. The plurality of point weighted sections 3 can vary in size and, in a configuration with three compartment sizes, comprises a small receptacle 31, an intermediate receptacle 32, and a large receptacle 33 as the different size receptacles are able to create different difficulty levels for the plurality of rollable playing pieces 5 to land during each game. Dividing 26 extend radially from the first flange to the second flange to form various sized receptacles having a size determined by the degree of separation of adjacent dividing walls. For example, a large receptacle may have dividing walls that are about 45 degrees offset, and a medium receptacle may have dividing walls that are about 30 degrees offset, and small receptacle may have dividing walls that are about 15 degrees offset. Any suitable degree of offset between dividing walls may define a receptacle, however, the size of the playing piece may need to be considered. The receptacles 31, may be angled from the first flange 21 to the second flange 22 so that the plurality of rollable playing pieces 5 is easily visible to the players of the present invention and so game pieces can be easily gathered for a subsequent game. Additionally, the small receptacle 31, the intermediate receptacle 32, and the large receptacle 33 can be lowered or raised so that the present invention can function as a flat-top table when the present invention is not utilized to play games. Although the present invention comprises linear dividing walls that are positioned in between each of the receptacles, the dividing walls can include additional shapes such as, circles (similar to skee-ball), sunrays, flower petals, sport team logos, and any other geometric or organic shapes. The small receptacle 31, the intermediate receptacle 32, and the large receptacle 33 can also be color-coded in order to simplify the scoring methods of the games. The annular collection area can also include sensors that activate embedded lights and audible sounds as the game pieces land in the collection areas or specific portions of the collection areas.

Since the annular collection area 2 is positioned around the game wheel 1, the lateral wall is adjacently positioned with the first flange 21 while the landing base 23 positions parallel with the smooth top surface 11. Due to the concentric positioning of the annular collection area 2 and the adjacent positioning of the lateral surface 13 and the first flange 21, the present invention is able to create a smooth transition for the plurality of rollable playing pieces 5 from the game wheel 1 to the annular collection area 2. More specifically, the smooth top surface 11 is positioned atop the landing base 23 so that the plurality of rollable playing pieces 5 can easily drop into one of the receptacles of the plurality of point weighted sections 3. Although the dividing walls that are positioned in between each of the receptacles includes a squared off top edge, the dividing walls can also be rounded or chamfered to allow a smooth transition for the plurality of rollable playing pieces 5.

In reference to FIG. 2, the base 4 of the present invention provides the necessary support for the game wheel 1 and the annular collection area 2. The base 4 can be configured into different forms depending on the different embodiments of the present invention. For example, the base 4 can be formed as a game table or a bar table so that the present invention can be utilized within casinos and bars respectively. The base 4 can also be formed as a small platform so that the present invention can function as a portable gaming or toy device. Even though the main functionality of the base 4 is to support the game wheel 1 and the annular collection area 2, the base 4 can provide a variety of other functionalities as follows. The base 4 can be equipped with a wireless router so that the players of the present invention are able to connect their wireless devices into a wireless network through the wireless router. The base 4 can also be equipped with a wireless technology standard for exchanging data over short distances so that the players are able to connect their electronic devices into a personal area network, such as radio frequency technology or infrared technology (RFID). Digital applications can be configured to track points, number of wins, locations played, etc. The base 4 may also comprise a plurality of embedded speakers and an audio unit to play music so that the music can be played through the audio unit. Additionally, an auxiliary port of the audio unit can accept a portable media player, if a player wants to play music through the portable media player. The base 4 may also comprise a plurality of cup holders, a plurality of cell phone charging ports, at least one score-display system, a plurality of hanging hooks, and a plurality of storage sections for the plurality of rollable playing pieces 5. The base can also be equipped with a coin operated system to distribute the plurality of rollable playing pieces 5 for the players, or supply power to the motor for a period of time, creating an arcade version of the present invention.

Figure 3:
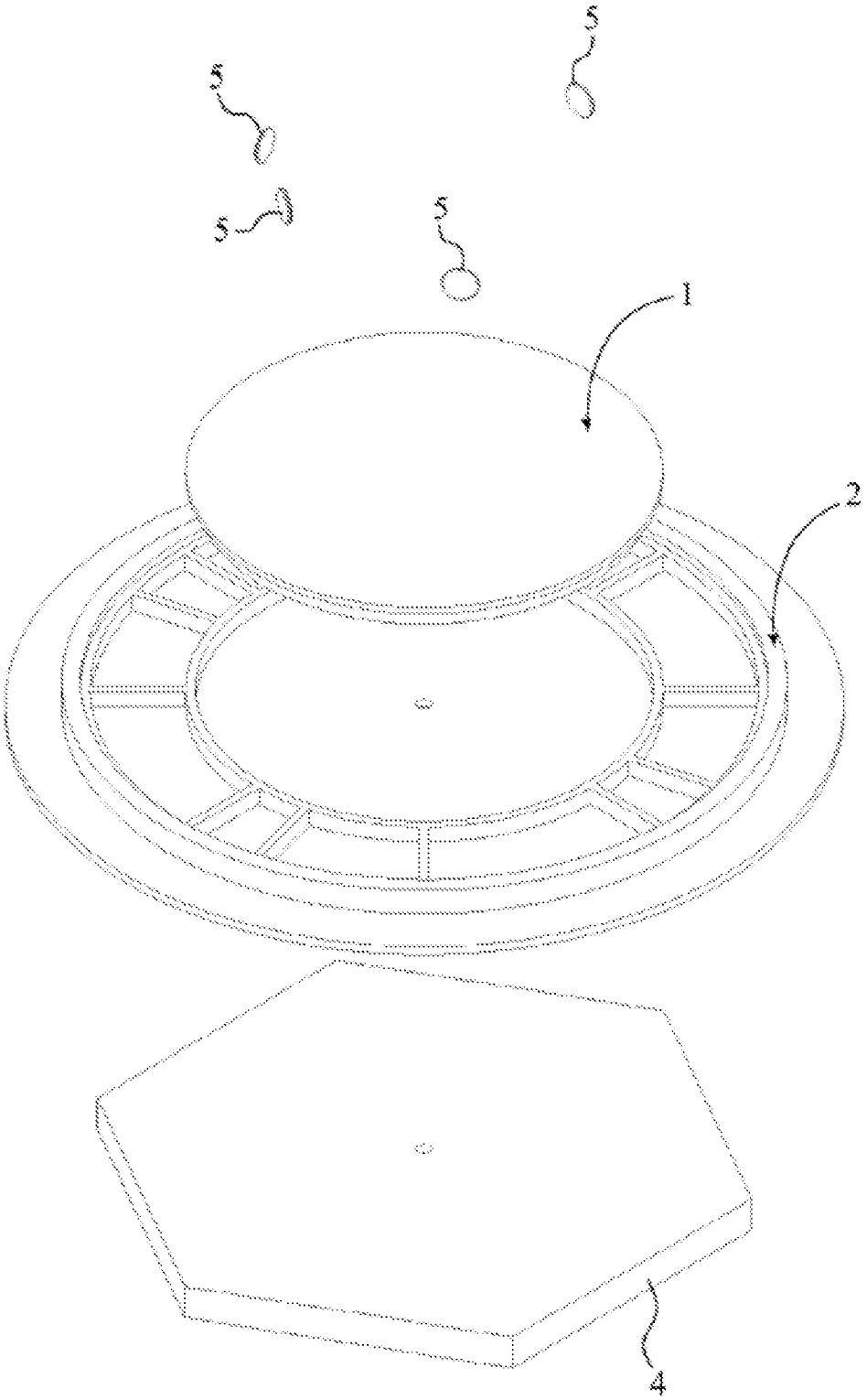
FIG. 3 is an exploded view of the first configuration for the preferred embodiment of the present invention.
Figure 8:
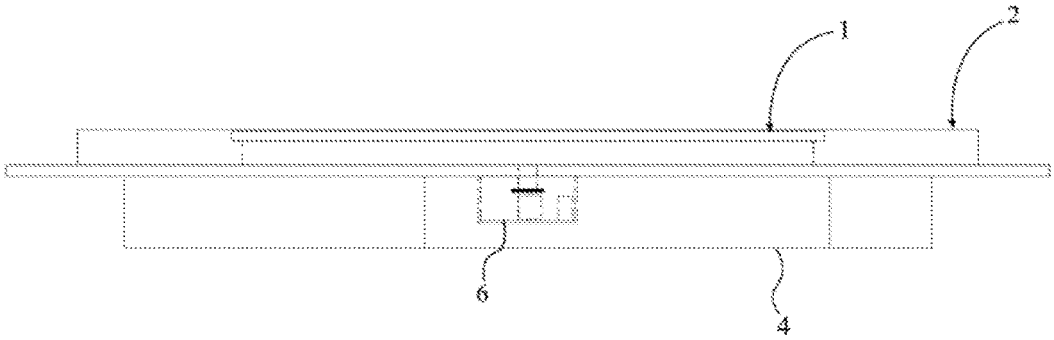
FIG. 8 is a side view of the second configuration for the preferred embodiment of the present invention, showing the rotating mechanism within the base.
Figure 9:
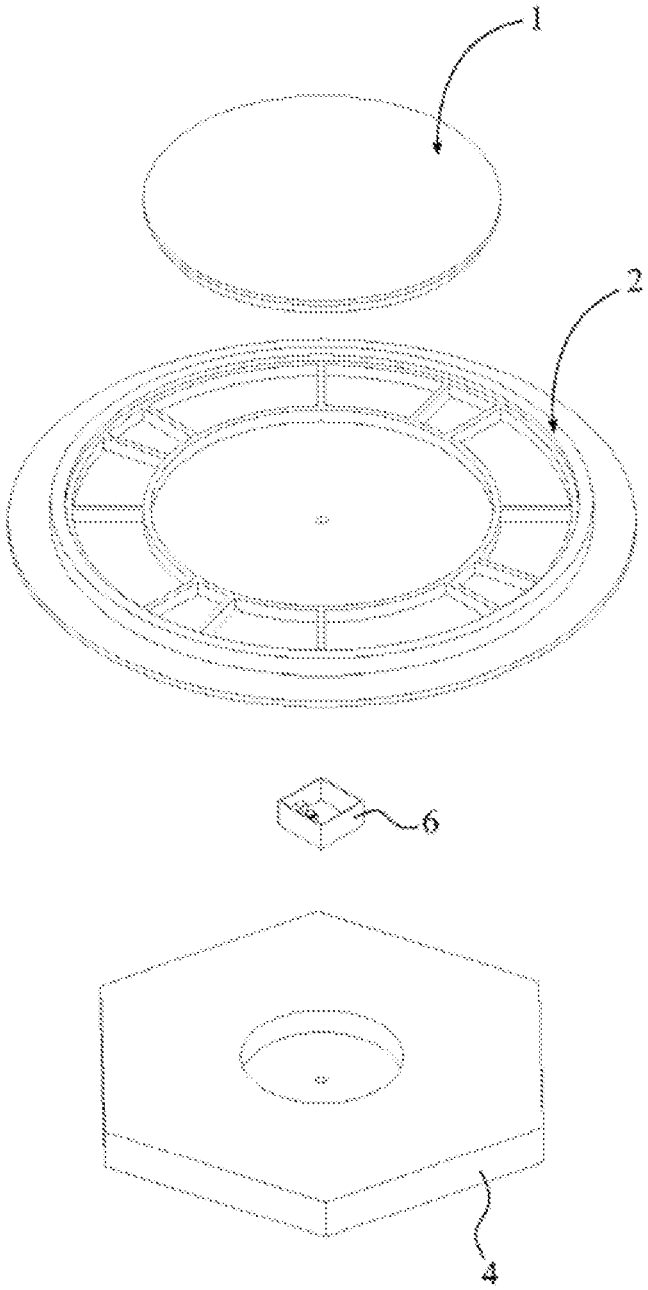
FIG. 9 is an exploded view of the second configuration for the preferred embodiment of the present invention.

In a preferred embodiment of the present invention, the game wheel 1 is axially connected with the base 4 while the annular collection area 2 is stationarily mounted to the base 4. The axial connection between the game wheel 1 and the base 4 allows the players of the preferred embodiment to rotate only the game wheel 1. In reference to FIG. 1-FIG. 3, a first configuration of the preferred embodiment allows the players to manually rotate the game wheel 1 at the beginning of each game. The players can freely rotate the game wheel 1 in either angular direction upon their preference at the start of each game. Once the game wheel 1 is rotated in the clockwise direction or the counterclockwise direction, the players have to continuously rotate the game wheel 1 in the respective angular direction until the game is finished. In order to maintain the angular speed of the game wheel 1, the game wheel 1 may comprise embedded weight on the bottom surface 12 near the lateral surface 13. Since the first configuration of the preferred embodiment does not utilize any complex mechanical systems, the first configuration can be easily manufactured and priced affordably. In reference to FIG. 8-FIG. 9, a second configuration of the preferred embodiment allows the players to control the rotation of the game wheel 1 as the game wheel 1 is operatively coupled to a rotating mechanism 6. The rotating mechanism 6 starts rotating the game wheel 1 in either the clockwise direction or the counterclockwise direction at the beginning of the game and continuously rotates the game wheel 1 during the game. For example, once the rotating mechanism 6 starts the rotation of the game wheel 1 in the clockwise direction or the counterclockwise direction, the rotating mechanism 6 continuously rotates the game wheel 1 in the respective angular direction until game is finished. The rotating mechanism 6 can include, but is not limited to, a belt driven motorized system, a shaft driven motorized system, a gear driven motorized system, an electro-magnetic repulsion system, a forced air system, a mechanical system, or any other type of mechanism that could easily rotate the game wheel 1. In order to ensure proper functionality of the rotating mechanism 6, the rotating mechanism 6 is completed with bearing system, guide wheels, housings, motors, clutches, and other related components. If the rotating mechanism 6 is powered through an external power source, the external power source electrically connects with the rotating mechanism 6 so that the game wheel 1 can be rotated within the present invention. The external power source can include, but is not limited to, a non-rechargeable battery, a rechargeable battery, renewable energy, or alternating current. Additionally, the players can control the angular direction and angular speed of the game wheel 1 through a control panel of the present invention as the control panel is electrically connected in between the external power source and the rotating mechanism 6. For example, the player can control the angular direction and angular speed of the game wheel 1 through a potentiometer of the control panel, preset speed settings of the control panel, or programmable settings. The collection area can also be easily stopped so players can sort and manually redistribute game pieces between games. The control panel also provides a kill switch so that the player can stop the operation of the present invention at any given time for safety purposes.

Figure 10:
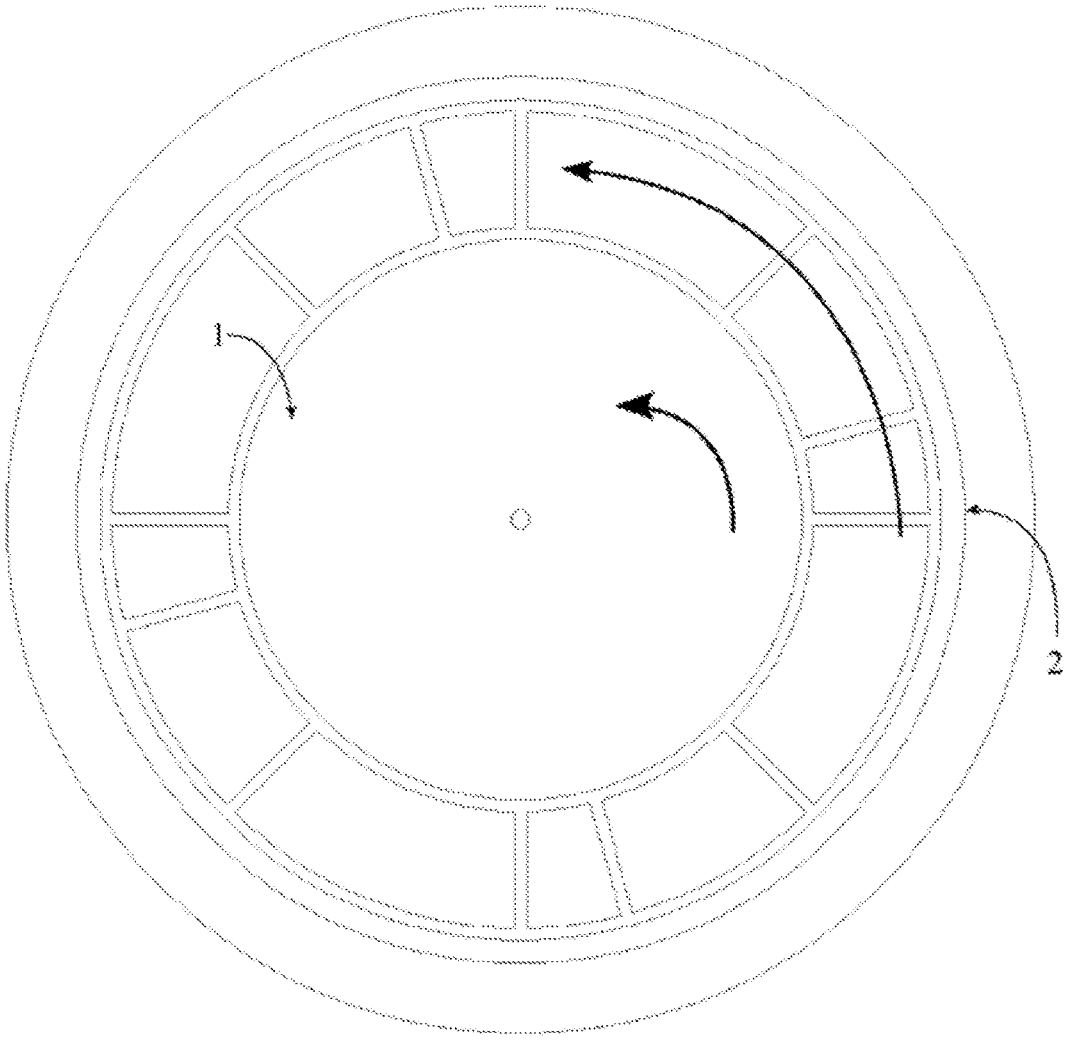
FIG. 10 is a top view of the alternative embodiment of the present invention, wherein the game wheel and the annular collection area rotate in same angular direction.
Figure 11:
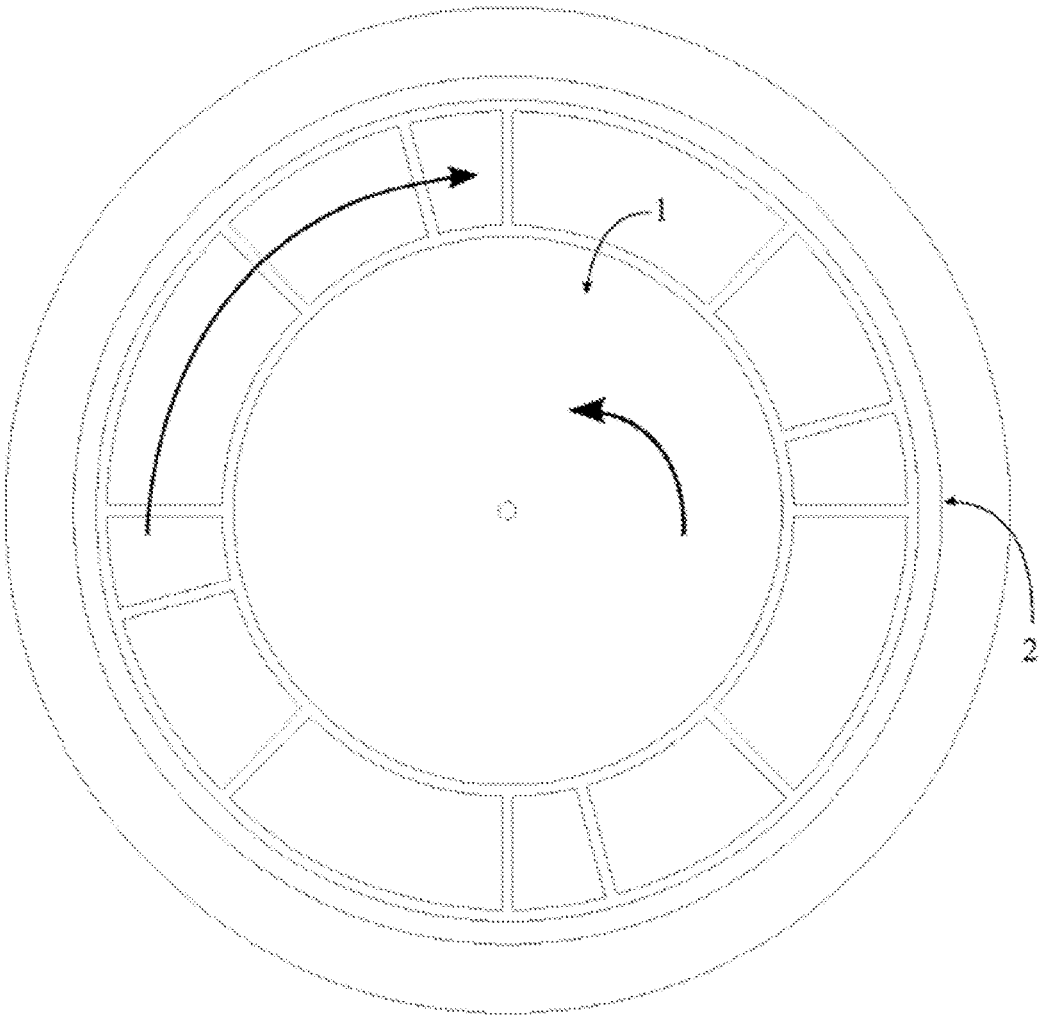
FIG. 11 is a top view of the alternative embodiment of the present invention, wherein the game wheel and the annular collection area rotate in opposite angular directions.

In an alternative embodiment of the present invention, the players can control the rotation of the game wheel 1 and the annular collection area 2 as the game wheel 1 and the annular collection area 2 are rotatably mounted onto the base 4. More specifically, the game wheel 1 is operatively coupled with at least one rotating mechanism 6 while the annular collection area 2 is also operatively coupled with the at least one rotating mechanism 6. The at least one rotating mechanism 6 is able to rotate both the game wheel 1 and the annular collection area 2 within the alternative embodiment. The at least one rotating mechanism 6 rotates the game wheel 1 and the annular collection area 2 in either angular direction at the beginning of the game and continuously rotates the game wheel 1 and the annular collection area 2 in their respective angular direction during the game. In reference to FIG. 10 and FIG. 11, the game wheel 1 and the annular collection area 2 can rotate in the same angular direction or opposite angular directions. Additionally, the players can control the angular direction and angular speed of the game wheel 1 and the annular collection area 2 through the control panel. For example, the player can control the angular direction and angular speed of the game wheel 1 and the annular collection area 2 by adjusting the potentiometer, the preset speed settings, or the programmable settings. Even though the annular collection area 2 of the alternative embodiment can be rotatable, the annular collection area 2 can be stationary positioned by the control panel upon the discretion of the players. In other words, the players can switch the annular collection area 2 in between a rotatable positioning and a stationary positioning through the control panel.

The plurality of rollable playing pieces 5, which are spun on the smooth top surface 11, generally determines the outcome of each game. In the present invention, the plurality of rollable playing pieces 5 is preferably formed into a disc-shaped. Even though the preferred embodiment comprises the disc-shaped plurality of rollable playing pieces 5, the plurality of rollable playing pieces 5 for present invention can include, but is not limited to, spherical shape, circular shapes, and any other type of rollable shapes. The plurality of rollable playing pieces 5 is preferably made from hard but dampened materials such as, plastic, composite, polycarbonate, acrylic, wood, hard rubber, silicon or combination of materials. A center of the each of the plurality of rollable playing pieces 5 is generally filled with material adding mass, such as metal disc or ring, magnetic disc or ring, or clay. When the plurality of rollable playing pieces 5 is spun on the smooth top surface 11, the plurality of rollable playing pieces 5 is tangentially positioned on the smooth top surface 11 and rolled in a manner as to match the linear velocity at the respective location on the smooth top surface 11. More specifically, when the plurality of rollable playing pieces 5 is spun on the smooth top surface 11, the plurality of rollable playing pieces 5 is eccentrically moved across the smooth top surface 11 before falling into the annular collection area 2. Each of the plurality of rollable playing pieces 5 comprises a rolling surface and a central portion, where the rolling surface is perimetrically positioned around the central portion to form the each of the plurality of rollable playing pieces 5. The rolling surface can be shaped into many different forms so that the different forms of rolling surfaces are able to provide different rolling characteristics for the plurality of rollable playing pieces 5. For example, the rolling surface can be shaped into a flat surface in order to maximize the surface area in between the rolling surface and the smooth top surface 11. However, if the rolling surface is shaped into a tapered surface, a circular surface, or a point surface, the surface area in between the rolling surface and the smooth top surface 11 can be minimized. The central portion, which aids the players to grip each of the plurality of rollable playing pieces 5, is shaped into different forms. For example, the central portion can be tapered inward, notched, protruded, and slanted inward from each side. The central portion may additionally comprise an opening or ball-bearing as the opening or the ball-bearing is concentrically traversed through the central portion. The different shapes of central portions provide different comfort levels for the players of the present invention and aid in matching the linear velocity of the smooth top surface 11 during the spinning process of the plurality of rollable playing pieces 5. For example, if the plurality of rollable playing pieces 5 comprises the opening, the players can hold each of the plurality of rollable playing pieces 5 with two fingers through the opening. As a result, the players are able to easily spin the plurality of rollable playing pieces 5.

Figure 12:
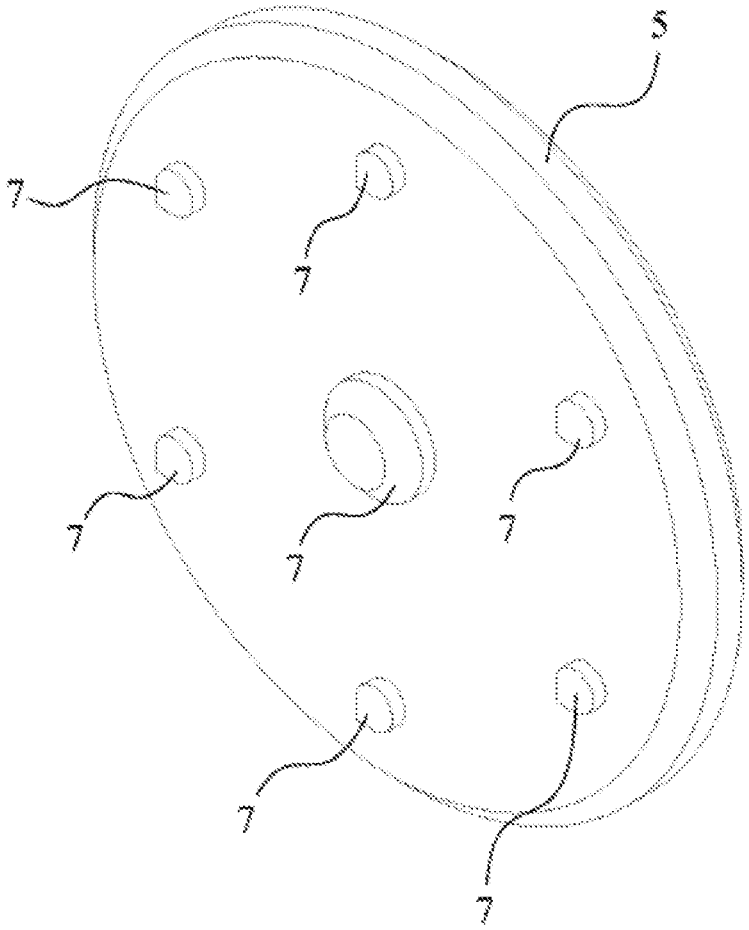
FIG. 12 is a perspective view of one of the plurality of rollable playing pieces showing the plurality of customizable accessories.

In reference to FIG. 12, the plurality of rollable playing pieces 5 comprises a plurality of customizable accessories 7, where the plurality of customizable accessories 7 changes the appearance of the plurality of rollable playing pieces 5. Before the each of the plurality of rollable playing pieces 5 is spun on the smooth top surface 11, at least one accessory from the plurality of customizable accessories 7 is selectively mounted onto each of the plurality of rollable playing pieces 5 upon the players' discretion. The players generally have the option to use the plurality of rollable playing pieces 5 with or without the plurality of customizable accessories 7 as the plurality of customizable accessories 7 can include, but is not limited to, added weights, decorations, magnets, spikes, hooks, pins, protrusions, decorative jewels, polymer rings, enclosed covers, lights, sound emitting devices, themed characters, or areas that extend from the centrifugal forces on the game piece. For example, the added weights can be mounted to one side of the plurality of rollable playing pieces 5 with the intent of having the heavier side towards the center of the game wheel 1. As a result, the plurality of rollable playing pieces 5 leans toward the middle of the game wheel 1 with the natural tendency of the game wheel 1 to force out the plurality of rollable playing pieces 5. In order to accept the plurality of customizable accessories 7, each of the plurality of rollable playing pieces 5 may comprise a plurality of attachment holes or openings. The plurality of attachment holes is either partially traversed into or fully traversed through each of the plurality of rollable playing pieces 5 and concentrically and evenly distributed with respect to the rolling surface so that the plurality of customizable accessories 7 can be evenly or unevenly positioned on the plurality of rollable playing pieces 5 upon the discretion of the players. More specifically, the plurality of customizable accessories 7 can be slightly imbalance from one side to other side, but the plurality of customizable accessories 7 must be radially balanced about either side of the plurality of rollable playing pieces 5 to prevent any kind of skip or chatter.

Figure 13:
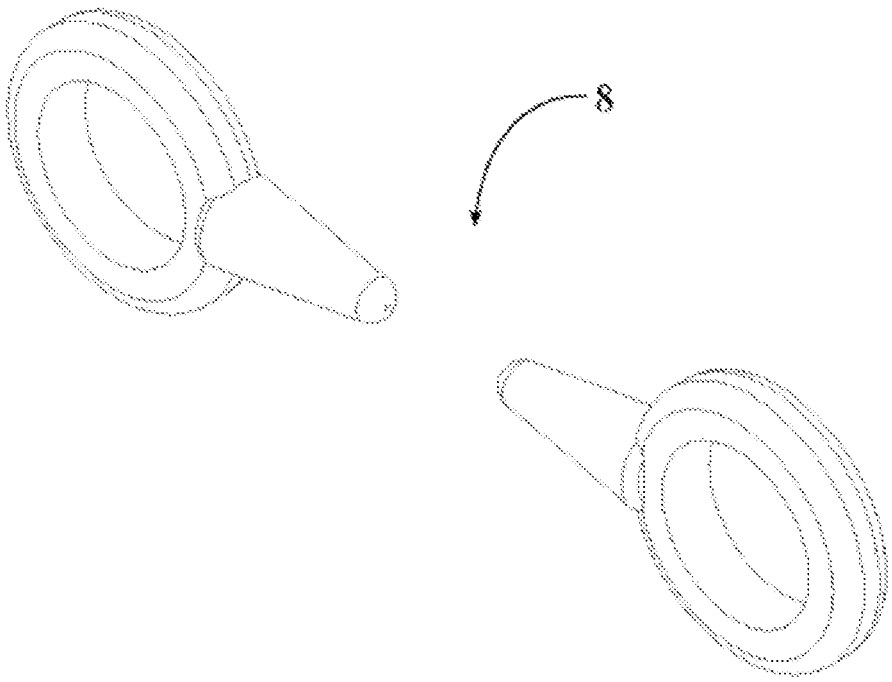
FIG. 13 is a perspective view of the pair of finger attachments.

The general launching method for the plurality of rollable playing pieces 5 comprises the steps of: Manually spinning each of the plurality of rollable playing pieces 5 using a flick of the wrist or rolling it from the fingertips to release the respective rollable playing pieces 5. More specifically, the plurality of rollable playing pieces 5 is released not only tangent to the smooth top surface 11 but also parallel to the lateral surface 13 and perpendicular to the center of the game wheel 1. Otherwise the plurality of rollable playing pieces 5 quickly falls from the game wheel 1. The plurality of rollable playing pieces 5 is also released at a speed close to the game wheel 1 speed and facing the respective angular direction of the game wheel 1. In order to properly master the launching method, the players need to practice the launching method. However, the plurality of rollable playing pieces 5 can further comprise a pair of finger attachments 8 that is preferably formed to match with the central portion of the plurality of rollable playing pieces 5 or a rolling aid 9. In reference to FIG. 13, each of the finger attachment 8 comprises a ring portion and an overhang portion as the ring portion linearly connects with the overhang portion. The ring portions secure the pair of finger attachments 8 to the fingers of the player while the overhang portions secure one of the plurality of rollable playing pieces 5 to the pair of finger attachments 8. For example, a pair of cone-shaped finger attachments 8 matches with a notched central portion for each of the plurality of rollable playing pieces 5 so that the players are able to achieve the correct speed and the angle for the plurality of rollable playing pieces 5 before releasing them onto the smooth top surface 11. The pair of finger attachments allows players to successfully and efficiently participate within the games that are played on the present invention while the players are able to master the launching method for the plurality of rollable playing pieces 5. A protrusion from the plurality of customizable accessories 7 can also be inserted through the ball-bearing if each of the plurality of rollable playing pieces 5 comprises the ball-bearing within the central portion. Then the protrusion aids the player to primarily hold and spin the plurality of rollable playing pieces 5.

Figure 14:
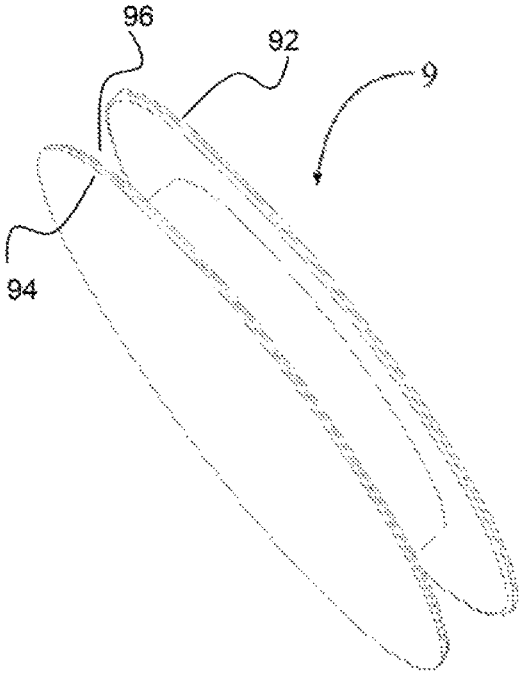
FIG. 14 is a perspective view of the rolling aid.
Figure 15:
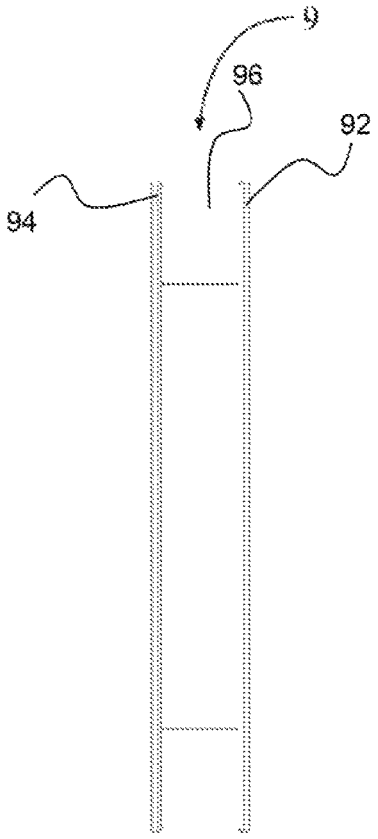
FIG. 15 is a side view of the rolling aid.

In reference to FIG. 14 and FIG. 15, the rolling aid 9 that is primarily used with the disc-shaped rollable playing pieces 5 allows the player or the operator of the present invention to rotate at least one rollable playing pieces 5, where the player is able to match the rotational speed of the at least one rollable playing pieces 5 with the rotational speed of the game wheel 1. More specifically, the rolling aid 9 comprises at least one retainer opening as the at least one retainer opening accepts one of the plurality of rollable playing pieces 5. A first extremity 92 and a second extremity 94 of the rolling aid 9 are held to contain the at least one rollable playing piece within the at least one retainer opening 96 of the rolling aid 9. Then the at least one rollable playing piece is engaged with the smooth top surface of the game wheel 11. Once the at least one rollable playing piece 5 reaches same velocity as the game wheel, the player or the operator can raise the rolling aid which then release the at least rollable playing piece onto the smooth top surface.

Since the plurality of rollable playing pieces 5 can be simultaneously positioned on the game wheel 1 and can exit the game wheel 1 at the same time, human eye may not be sufficient enough to determine the accurate results of the games. In order to accurately determine the winner of each game and to avoid any disagreement in between the players, the game wheel 1 and the plurality of rollable playing pieces 5 can each comprise an embedded sensor, load cell detecting weight, or a radio-frequency identification (RFID) unit so that the present invention is able to accurately track and determine the positioning of the plurality of rollable playing pieces 5 with respect to the game wheel 1. The embedded sensors or the RFID units of the game wheel 1 and the plurality of rollable playing pieces 5 communicate with the at least one score-display system of the present invention so that the present invention is able to correctly determine and display the accurate results to the players. Accurate results can also be determined in a plurality of additional ways, such as through optical systems, lasers, magnets, etc.

Figure 16:
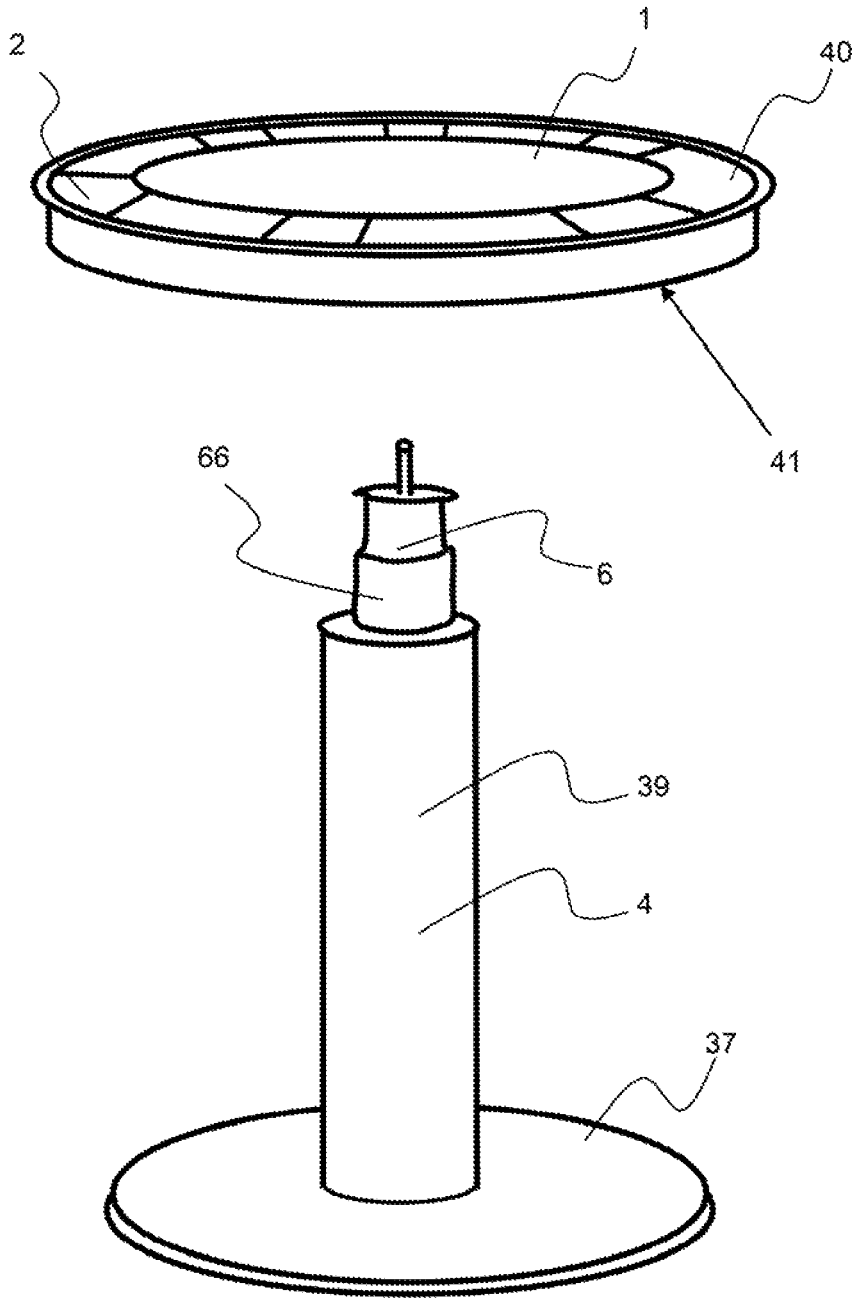
FIG. 16 shows a perspective view of an exemplary competitive game with spinning game wheel having a motor driven base apparatus.

As shown in FIG. 16, an exemplary competitive game 41 with spinning game wheel 1 has a motor 66 that is coupled with a stand 39 and drives the game wheel. The stand has a stand base to provide stability. The game top 40 is shown detached from the base 37. A drive mechanism 6, such as a motor 66, may be configured with the game top and the competitive game may be placed on a table or other substantially flat surface.

Figure 17:
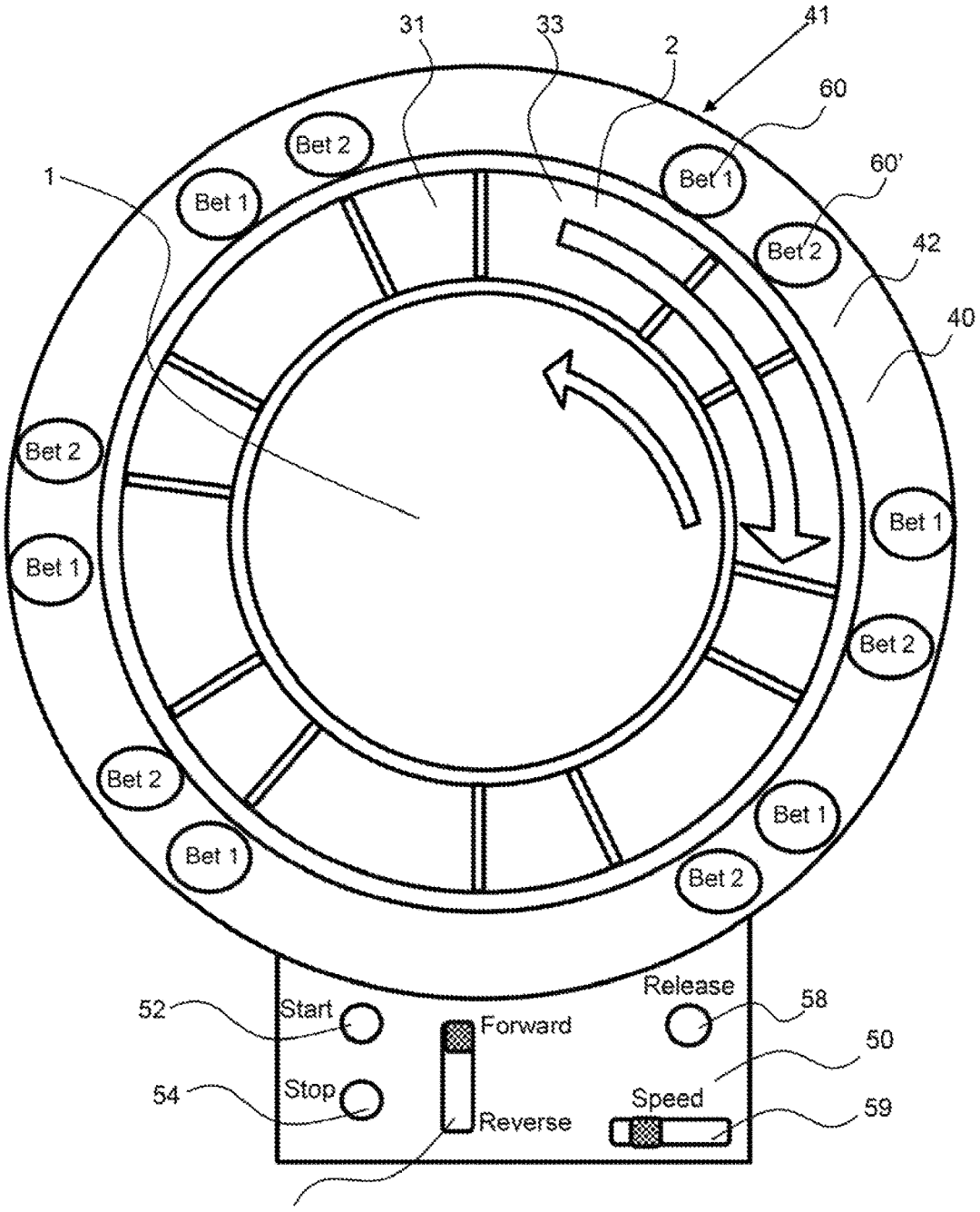
FIG. 17 shows a top view of an example exemplary competitive game with spinning game wheel.
Figure 18:
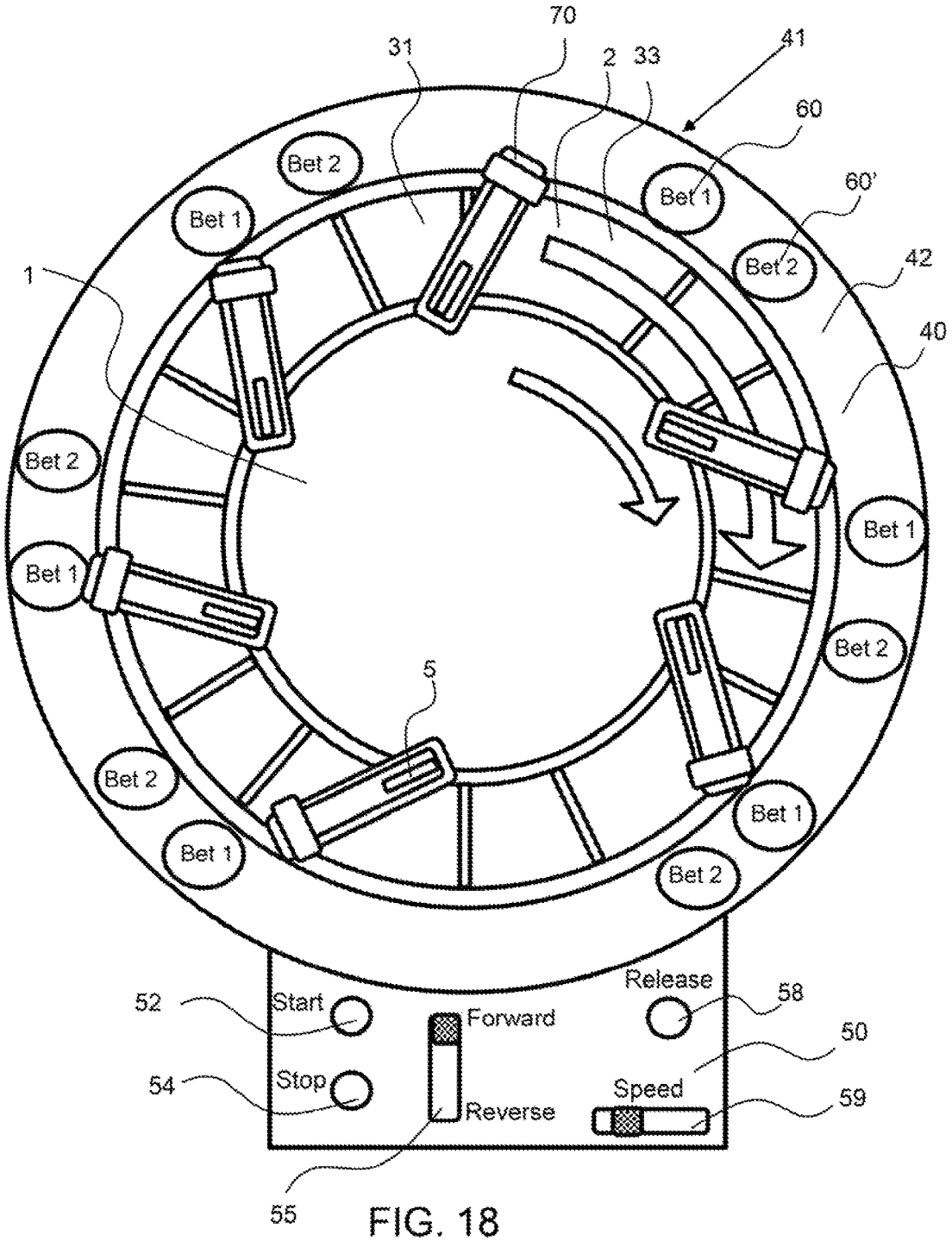
FIG. 18 shows a top view of an example exemplary competitive game with spinning game wheel having playing piece launch fixtures.

As shown in FIGS. 17 and 18, an example exemplary competitive game 41 with spinning game wheel 1 comprises collection 2 areas around the perimeter of the circular shaped game wheel. In this embodiment, there is a small receptacle 31 and a large receptacle 33 in the collection area 2. The collection area is spinning counter to the game wheel as indicated by the bold arrows. A controller 50 is shown having a start 52 and stop 54 control, as well as a directional controller 55. The directional controller may be used to control the direction of rotation of the game wheel 1 and/or the collection area 2. For example, forward may spin both the game wheel and collection area in the same direction and reverse may spin them in opposing directions. A speed controller 59 may allow control of the rotational speed of the game wheel and/or the collection area. There may be separate speed controllers for game wheel and collection area. The rotational speed may be maintained by a single or multiple drive mechanism, such as an electric motor. Also shown in FIG. 17 is a game top perimeter 42 that is stationary and does not spin. The game top perimeter has a plurality of bet locations 60, 60' for a player to place a wager on the outcome of a game. As shown, there are six separate bet locations configured around the perimeter that allow up to six players to place a wager on any number of outcomes, such as being the last playing piece on the game wheel, having their game piece land on the game wheel surface, or on landing in one of the collection areas. As shown in FIG. 18, the competitive game comprises a playing piece launch fixtures 70 configured around the perimeter of the game wheel 1 and configured to retain a playing piece 5 and release the playing piece onto the game wheel.

Figure 19:
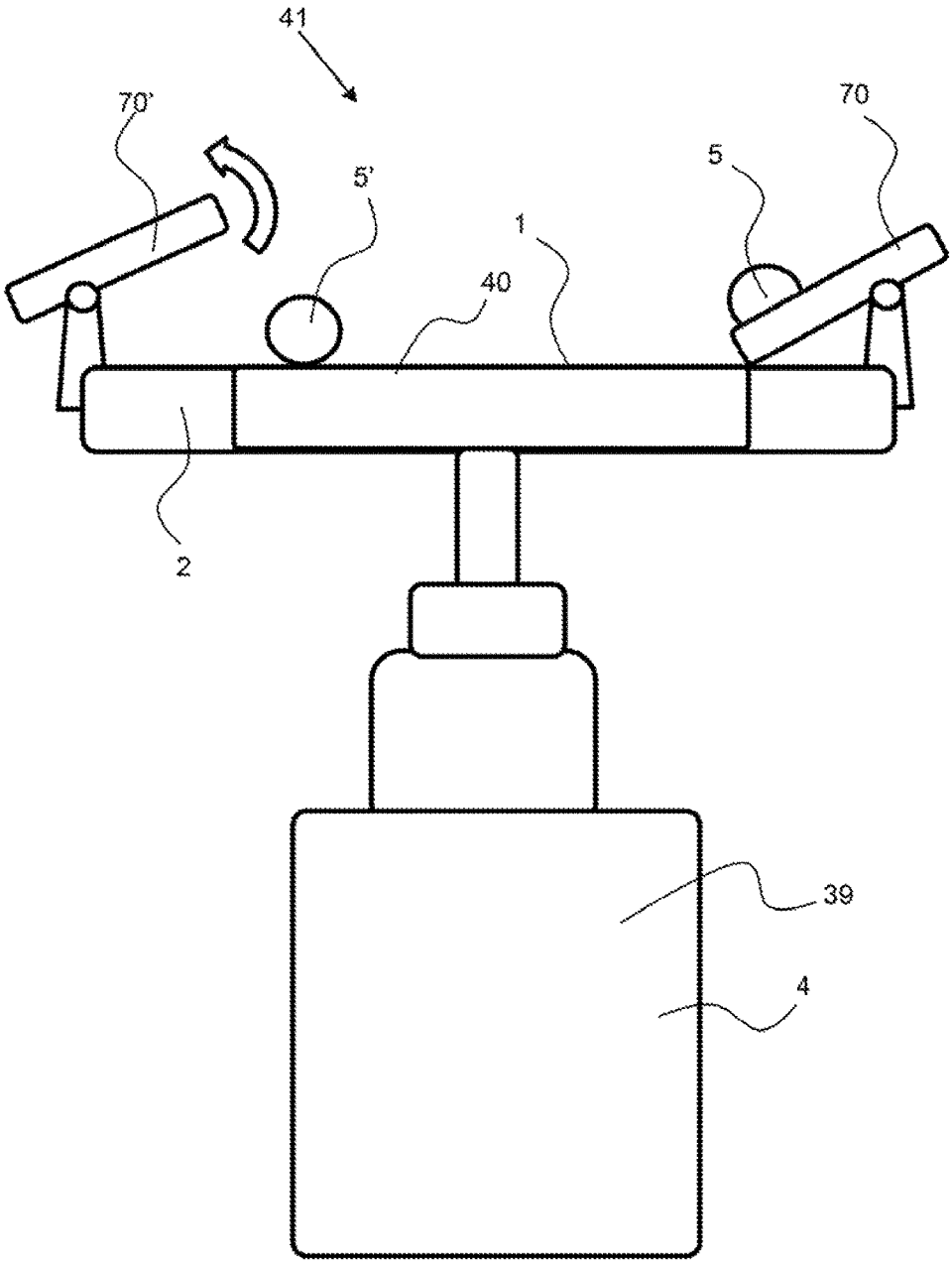
FIG. 19 shows a side view of an example exemplary competitive game with spinning game wheel having playing piece launch fixtures.

As shown in FIG. 19 an example exemplary competitive game 41 with spinning game wheel 1 has playing piece launch fixtures 70, 70'. Playing piece launch fixture 70 is retaining the playing piece 5 and playing piece launch fixture 70' has released or launched the playing piece 5' and is retracted up and/or back out of the way to allow the playing pieces to roll onto the spinning game wheel 1 and into the collection area 2. The playing piece launch fixtures may be spring loaded and pivot up away from the spinning game wheel 1 after releasing the playing piece. In addition, as shown in FIG. 18, a release controller 58 may be configured to release a plurality or all of the playing pieces from each of the playing piece launch fixtures at substantially the same time, such as within about 1 to 2 seconds of each other. In an exemplary embodiment, players would place a wager on the game piece that will be the last one remaining on the turntable, for example betting on color/identifier A, B, C, or D. Though countless embodiments and multiples are possible, an exemplary embodiment could include thirteen active launch fixtures 70 each with a game piece loaded onto the launching fixture. Accounting for nearly half of the total number of game pieces, six of the game pieces would be color/identifier A and would pay out 1:1 to a winner. Accounting for nearly one-third of the total number of game pieces, 4 of the game pieces would be color/identifier B and would pay out 3:1 to a winner. Accounting for nearly one-sixths of the total number of game pieces, 2 of the game pieces would be color/identifier C and would pay out 6:1 to a winner. One of the thirteen game pieces would be color/identifier D and would pay out 12:1 to a winner. In this example with fewer game pieces than roulette numbers, the casino would have a higher house edge compared to a game like roulette, and would be very entertaining to players, watching thirteen game pieces released at the same time and roll eccentrically on a spinning turntable 1 until a winner is determined by being the last game piece on the turntable. The outer ring can include collection areas of similar or dissimilar sizes that can serve as additional wager multipliers or players can bet on which receptacle the last game piece will land. Additionally, players can bet if the last game piece will land or come to rest in the center of the turntable. The game pieces may be equipped with RFID or similar technology chips to reduce the likelihood of a perceived tie. A game host such as a casino operator may then start the spinning game wheel 1 and use the release controller 58 to launch the playing piece onto the spinning game wheel 1. Players may win or lose their wager based on the outcome of the game. For example, a player may wager on a certain color/identifier, and may also wager that their playing piece lands in the small receptacle. The wager pay-outs may be different depending on the odds of one event happening. For example, it may be a low probability that a playing piece lands on the center of the game wheel and therefore the pay-out may be 10 to 1, whereas a pay-out for a wager on landing in small receptacle is only 2 to 1.

Additionally, game piece size or RFID or similar technology embedded in the game pieces can be used to automatically redistribute game pieces to specific player locations, negating the need for players to sort and manually redistribute game pieces between games. RFID Technology could also be utilized in the casino version of the game, whereby players select which game piece color or identifier will win and place bets in the form of money, chips, or scrip on an outer betting area. A game operator would load a predetermined number of game pieces with unique color or identifiers into loading areas and the number of uniquely identified game pieces in relation to the total number of game pieces would determine the amount to be paid to the winner. In operation, a plurality of game pieces would be simultaneously loaded into a ramp or launching device, the ramp would extend over the spinning turntable, and all game pieces would be simultaneously released onto the game wheel using a pin, gate, magnet, or other method to coordinate the game piece release. After releasing the game pieces, the ramps or launching device would retract distal to the game wheel and collection area. The plurality of collection areas would be used as winning multiplier or side bets and RFID embedded game pieces would be used to determine a clear winner in each round.

Figure 20:
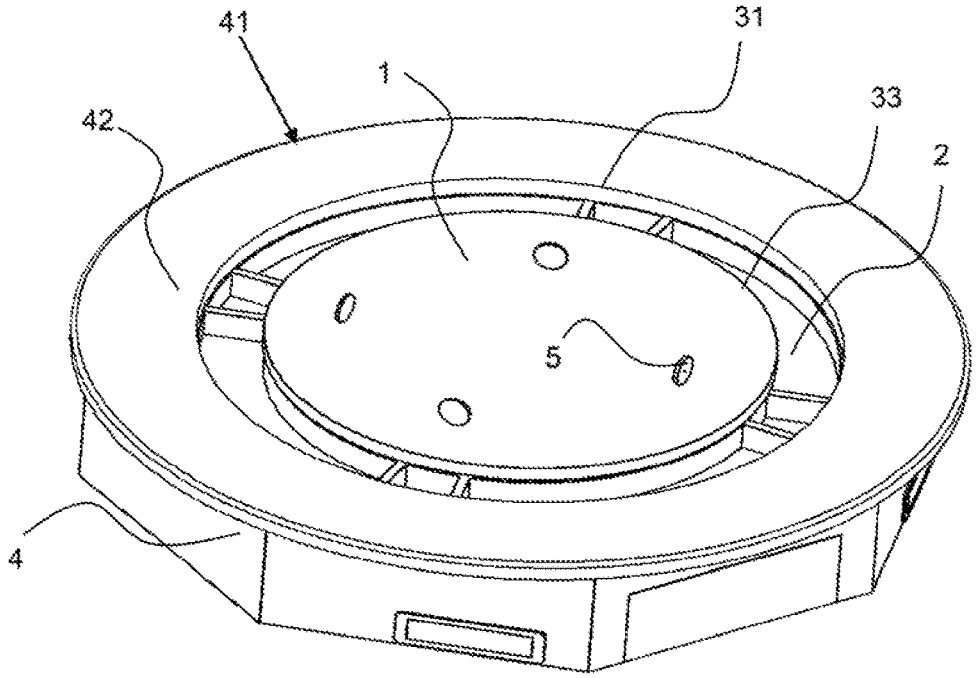
FIG. 20 shows a perspective view of an exemplary competitive game with spinning game wheel and a collection area having small and large receptacles evenly spaced around the game wheel.

As shown in FIG. 20, an exemplary competitive game 41 with spinning game wheel 1 and a collection area 2 has small receptacles 31 and large receptacles 33 evenly spaced around the game wheel or within the collection area. A game top perimeter 42 extends around the collection area.

Figure 21:
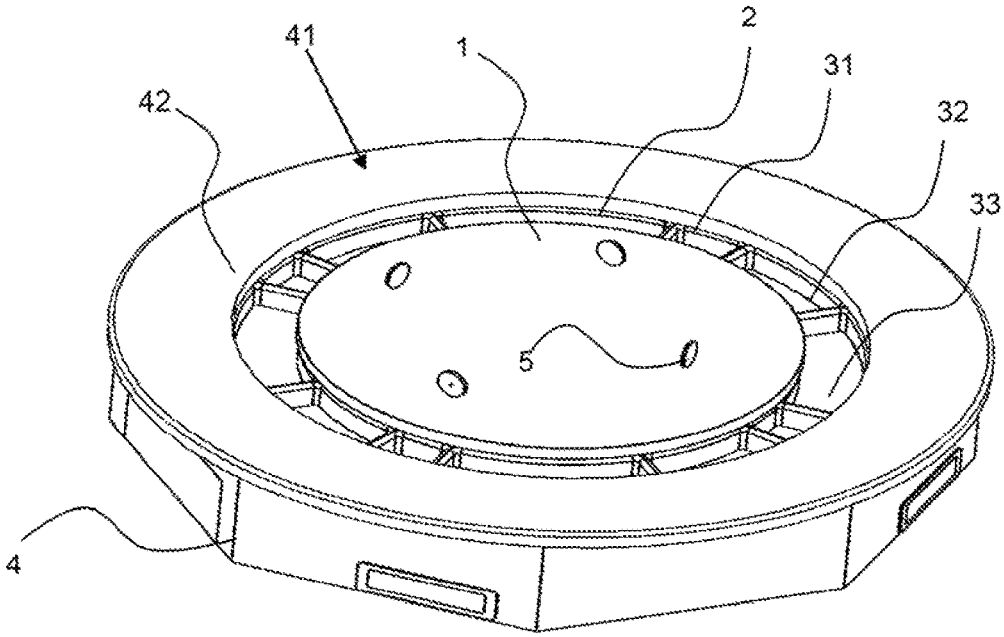
FIG. 21 shows a perspective view of an exemplary competitive game with spinning game wheel and a collection area having small, intermediate and large receptacles evenly spaced around the game wheel.

As shown in FIG. 21, an exemplary competitive game 41 with spinning game wheel 1 and a collection area 2 has small receptacles 31, intermediate receptacles 32 and large receptacles 33 evenly spaced around the game wheel or within the collection area. A game top perimeter 42 extends around the collection area.

Figure 22:
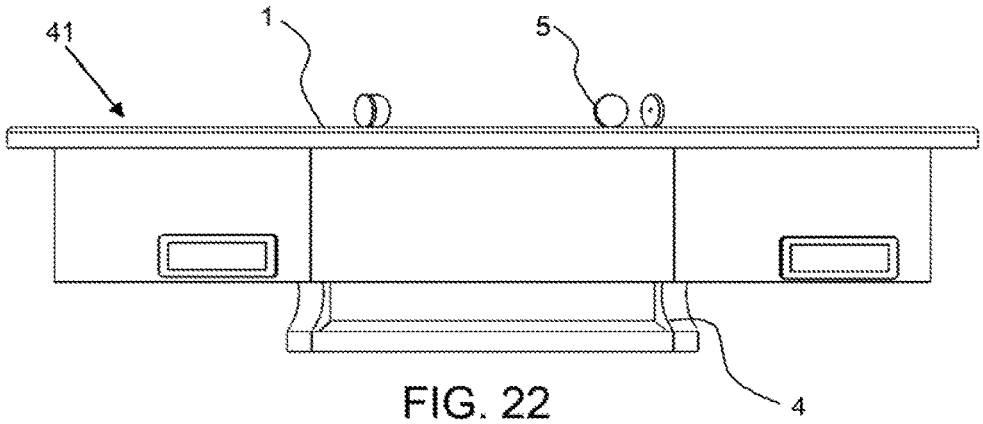
FIG. 22 shows a side view of an exemplary competitive game with spinning game wheel having playing pieces on the game wheel.

As shown in FIG. 22, an exemplary competitive game 41 with spinning game wheel 1 has playing pieces 5 rolling on the spinning game wheel.

Figure 23:
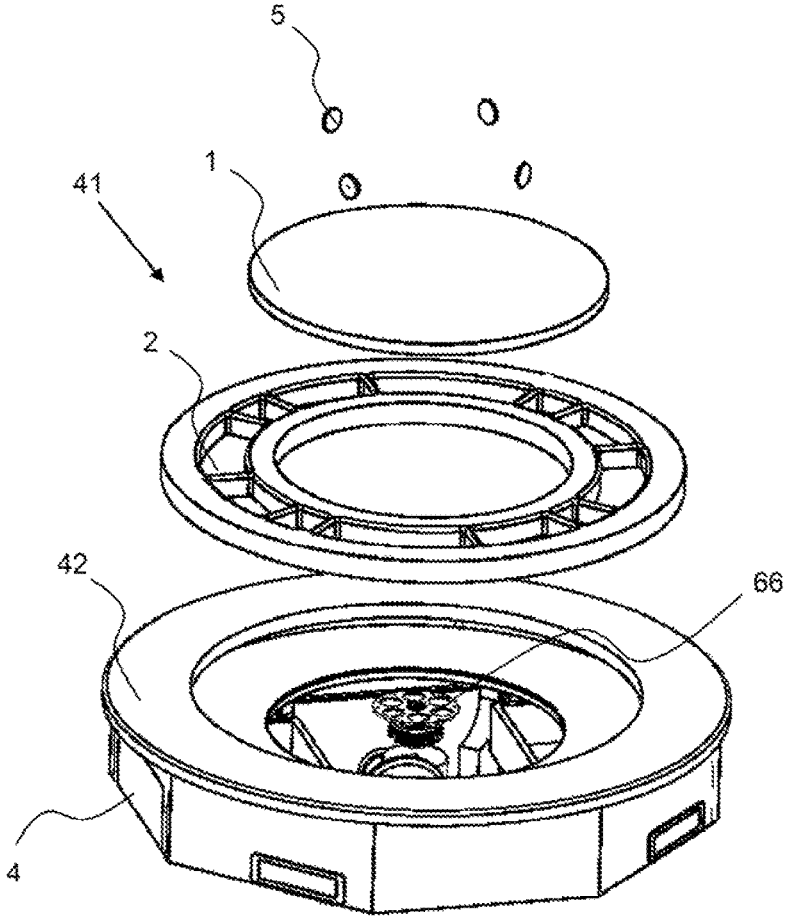
FIG. 23 shows an exploded view of an exemplary competitive game with spinning game wheel having a motor driven base apparatus.
Figure 24:
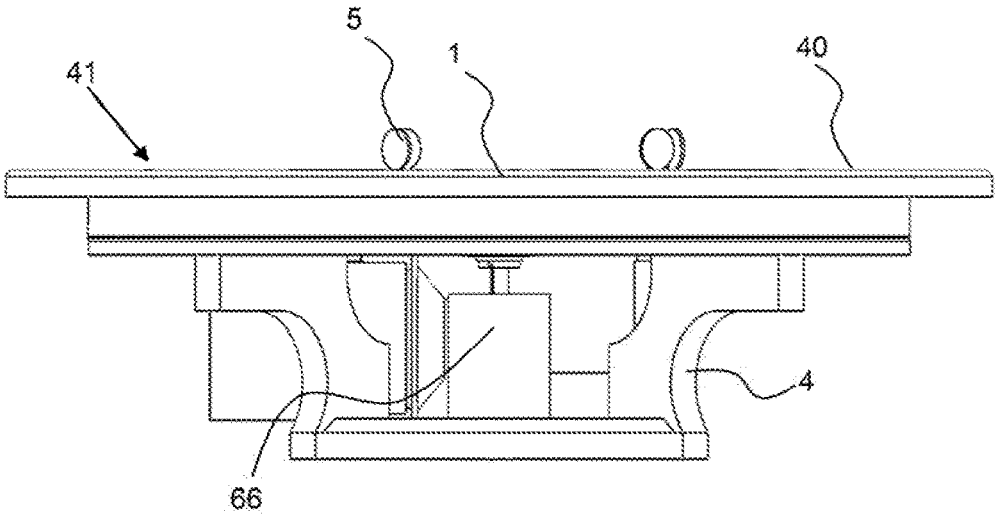
FIG. 24 shows a side view of an exemplary competitive game with spinning game wheel having a motor driven base apparatus.

As shown in FIG. 23 an exemplary competitive game 41 with spinning game wheel 1. The collection area 2 has a plurality of receptacles configured in a ring around the game wheel. The base 4 has a motor 66 that is configured to couple with at least the game wheel 1 to rotate or spin the game wheel. FIG. 24 shows a side view of an exemplary competitive game with spinning game wheel having a motor driven base apparatus.

Figure 25:
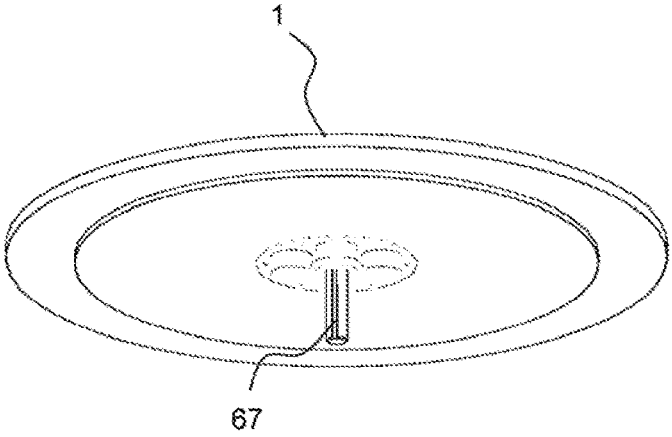
FIG. 25 shows a game wheel attached to a drive shaft that is configured to couple with a motor to spin the game wheel.

Referring to FIGS. 24 and 25, an exemplary competitive game 41 with spinning game wheel 1 has playing pieces 5 rolling on the spinning game wheel. The base 4 has a motor 66 for spinning the game wheel 1. A drive shaft 67 extends from the motor to the game wheel 1 to spin the game wheel. It is to be understood that the drive mechanism or motor may be coupled to the motor through a belt or gears or any other suitable coupling arrangement.

Figure 26:
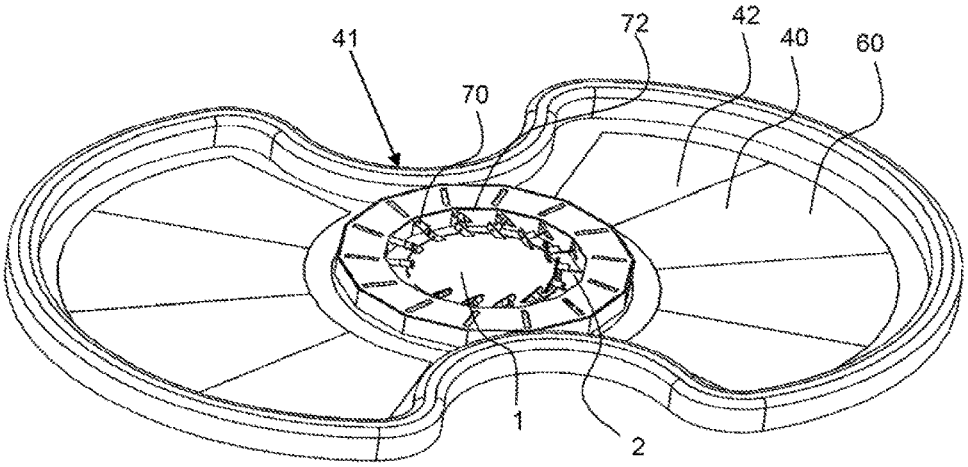
FIG. 26 shows a perspective view of an exemplary competitive game with spinning game wheel and a plurality of playing piece launch fixtures that are extended to release a playing piece onto the game wheel.
Figure 27:
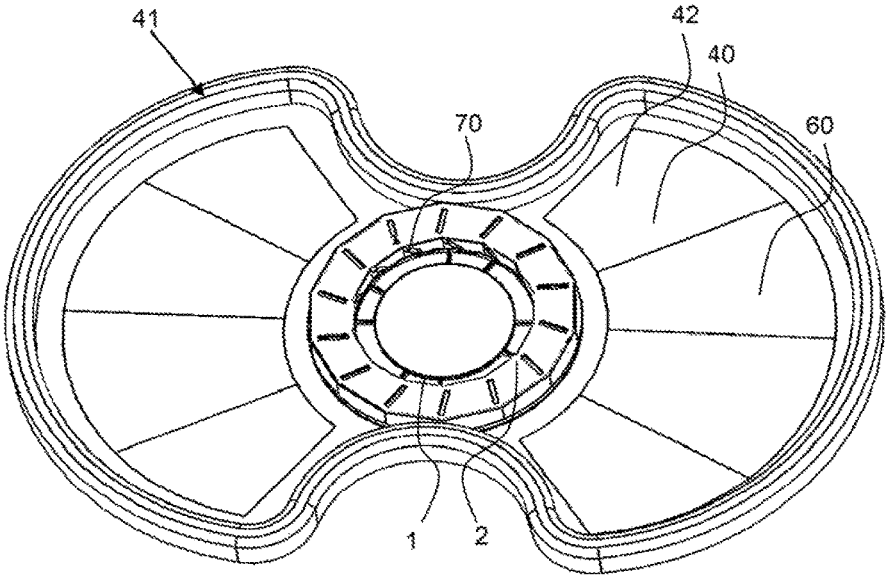
FIG. 27 shows a perspective view of an exemplary competitive game with spinning game wheel and a plurality of playing piece launch fixtures that are retracted.
Figure 28:
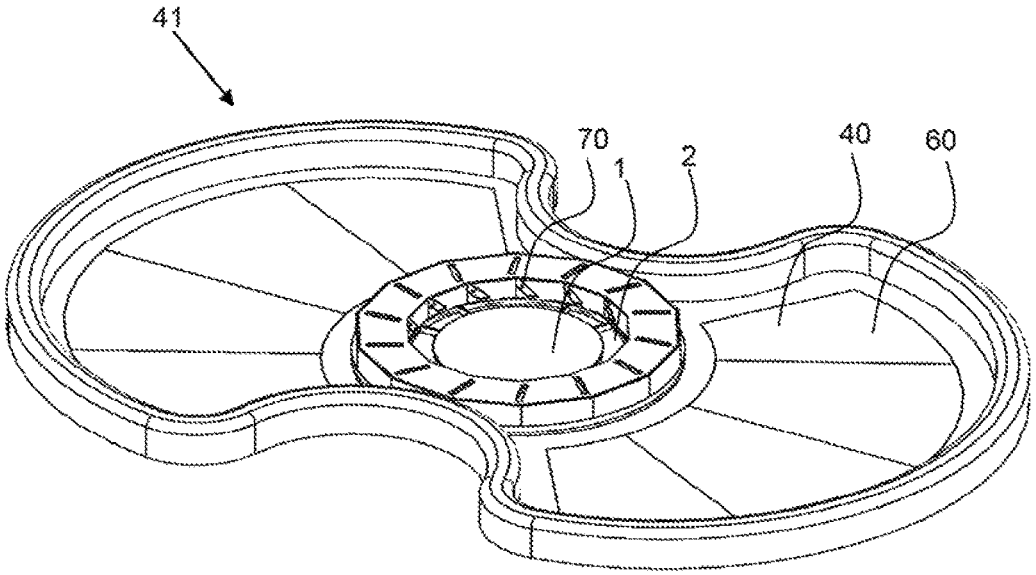
FIG. 28 shows a perspective view of an exemplary competitive game with spinning game wheel and a plurality of playing piece launch fixtures that are retracted.
Figure 29:
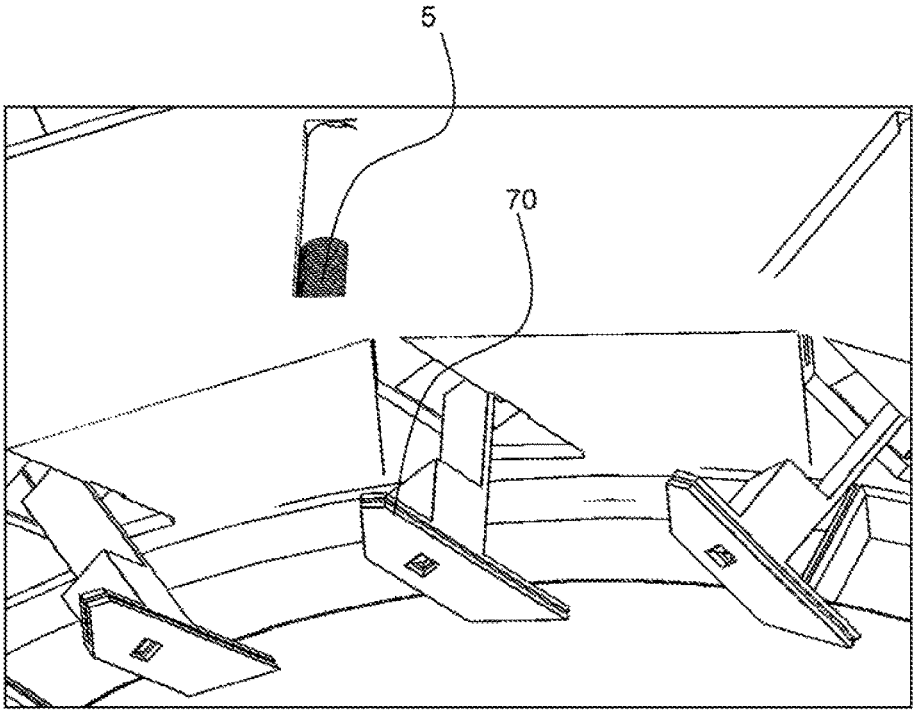
FIG. 29 shows an exemplary playing piece launch fixtures.

Referring to FIGS. 26 to 29, an exemplary competitive game 41 with spinning game wheel 1 has a plurality of playing piece launch fixtures 70 that are configured to extend out to launch playing pieces onto the spinning game wheel and then retract to not interfere with the playing pieces as they roll off the edge of the game wheel and into the collection area 2. Betting locations 60 are configured around the game wheel to provide one or more players to place a bet on the outcome of the game. For example, a player may place a bet on what playing piece color/identifier will be the last playing piece on the game wheel or that the last playing piece will land in one of the collection areas. As shown in FIG. 26, the playing piece launch fixtures 70 are extended over the spinning game wheel 1 to release the playing pieces. As described herein, the playing piece launch fixtures 70 may all release the playing pieces at substantially the same time. A game release device may be configured to control the release of the playing pieces from the playing piece launch fixtures. As shown in FIGS. 27 and 28 the playing piece launch fixtures 70 are in a retracted configuration so that they will not interfere with the playing pieces as they roll onto the game wheel 1 and into the collection area 2. As shown in FIG. 29 the playing piece launch fixtures 70 are in an extended configuration and when retracted, a new playing piece 5 may be automatically loaded into the playing piece launch fixtures.

Although the invention has been explained in relation to its preferred embodiment, it is to be understood that many other possible modifications and variations can be made without departing from the spirit and scope of the invention as hereinafter claimed.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A competitive game apparatus comprising:

a plurality of disc shaped rollable playing pieces having a first and an opposing second side;

an outer perimeter that is substantially circular in shape defining a disc-edge;

a base;

a game wheel rotatably connected to the base and comprising;

a circular top surface having a top surface area extending within a perimeter of the game wheel;

wherein the top surface is a flat surface and the top surface area consists of said flat surface the extends continuously across the top surface area within said perimeter of the circular top surface; and wherein the circular top surface is exposed to game players and configured to receive said plurality of disc shaped rollable playing pieces while said game wheel is rapidly spinning;

a bottom surface; and a lateral surface;

a rotating mechanism comprising:

a motor configured under the bottom surface of the game wheel and coupled with the game wheel to rapidly spin the game wheel at a constant speed during game play;

wherein the game wheel is rapidly spun with respect to said base that is stationary;

an annular collection area configured below and around an outer perimeter of the game wheel and comprising:

a first flange configured around and adjacent to the lateral surface of the game wheel;

a second flange offset radially from first flange; and a landing base configured between the first flange and the second flange;

a plurality of dividing walls that extend from the first flange to the second flange that create a plurality of receptacles;

wherein each of said plurality of receptacles defines a point weighted section;

a plurality of game scoring locations comprising:

said point weighted sections; and at least a portion of the smooth top surface;

wherein said flat top surface extends continuously between the annular collection area thereby allowing the plurality of disc shaped rollable playing pieces to roll uninhibited across the entirety of said surface area of the top surface of the game wheel and roll into one of the plurality of receptacles within the annular collection area or land on the smooth top surface;

whereby in use, the plurality of disc shaped rollable playing pieces are released onto the smooth top surface of the game wheel and roll across the game wheel where they drop into one of the plurality of receptacles within the annular collection area or land on the smooth top surface;

wherein the rotating mechanism rotates the game wheel and the annular collection area that is operatively coupled with the rotating mechanism; and wherein the game wheel and the annular collection area are rotated in the same annular direction and wherein the annular collection area is rotated at a lower speed than the game wheel.

2. The competitive game apparatus with spinning game wheel and playing pieces as claimed in claim 1, wherein the plurality of receptacles comprises a first receptacle that is a small receptacle and the second receptacle that is a large receptacle, wherein the small receptacle is smaller than the large receptacle.

3. The competitive game apparatus with spinning game wheel and playing pieces as claimed in claim 2;

wherein the small receptacle has a higher point value than said large receptacle.

4. The competitive game apparatus with spinning game wheel and playing pieces as claimed in claim 2, comprising an intermediate receptacle that is larger than the small receptacle and smaller than the large receptacle.

5. The competitive game apparatus with spinning game wheel and playing pieces as claimed in claim 1, wherein the annular collection area is configured concentrically completely around the game wheel and wherein the plurality of receptacles are evenly distributed around the annular collection area.

6. The competitive game apparatus with spinning game wheel and playing pieces as claimed in claim 1, wherein the lateral surface is adjacently positioned with the first flange;

wherein the landing base is positioned substantially parallel with the smooth top surface; and wherein the smooth top surface of the game wheel is positioned above the landing base.

7. The competitive game apparatus with spinning game wheel and playing pieces as claimed in claim 1, wherein the annular collection area is stationarily coupled to the competitive game apparatus and does not rotate.

8. The competitive game apparatus with spinning game wheel and playing pieces as claimed in claim 1, wherein the motor is an adjustable speed motor and further comprising a controller having a speed set feature.

9. The competitive game apparatus with spinning game wheel and playing pieces as claimed in claim 1, further comprising a playing piece launch fixture attached to the game apparatus around the outer perimeter of the game wheel, for retaining and releasing at least one of the plurality of disc shaped rollable playing pieces upright onto the spinning game wheel such that the plurality of disc shaped rollable playing pieces are released with said outer perimeter contacting the game wheel and said first and second sides extending substantially perpendicularly to the smooth top surface of the game wheel, at the respective launch fixture, and wherein the annular collection area and said playing piece launch fixture are stationarily coupled to the competitive game apparatus and do not rotate when the game wheel rotates.

10. The competitive game apparatus with spinning game wheel and playing pieces as claimed in claim 9, comprising a plurality of playing piece launch fixtures attached to the game apparatus around the outer perimeter of the game wheel and wherein the annular collection area and the plurality of said playing piece launch fixtures are stationarily coupled to the competitive game apparatus and do not rotate when the game wheel rotates.

11. The competitive game apparatus with spinning game wheel and playing pieces as claimed in claim 10, wherein the plurality of disc shaped rollable playing pieces each have an associated value.

12. The competitive game apparatus with spinning game wheel and playing pieces as claimed in claim 10, further comprising a game release feature that is coupled with each of the plurality of playing piece launch fixtures and configured to release each of the plurality of disc shaped rollable playing pieces from the playing piece launch fixtures at substantially the same time.

13. A competitive game apparatus with spinning game wheel and playing pieces comprising:

a plurality of disc shaped rollable playing pieces having a first and an opposing second side;

an outer perimeter that is substantially circular in shape defining a disc-edge;

a base;

a game wheel rotatably connected to the base and comprising:

a circular top surface having a top surface area extending within a perimeter of the game wheel;

wherein the top surface is a flat surface and the top surface area consists of said flat surface the extends continuously across the top surface area within said perimeter of the circular top surface; and wherein the circular top surface is exposed to game players and configured to receive said plurality of disc shaped rollable playing pieces while said game wheel is rapidly spinning:

a bottom surface; and a lateral surface;

a rotating mechanism comprising:

a motor configured under the bottom surface of the game wheel and coupled with the game wheel to rapidly spin the game wheel at a constant speed during game play;

wherein the game wheel is rapidly spun with respect to said base that is stationary;

an annular collection area configured below and around an outer perimeter of the game wheel and comprising:

a first flange configured around and adjacent to the lateral surface of the game wheel;

a second flange offset radially from first flange; and a landing base configured between the first flange and the second flange;

a plurality of dividing walls that extend from the first flange to the second flange that create a plurality of receptacles;

wherein each of said plurality of receptacles defines a point weighted section;

a plurality of game scoring locations comprising:

said point weighted sections; and at least a portion of the smooth top surface;

wherein said flat top surface extends continuously between the annular collection area thereby allowing the plurality of disc shaped rollable playing pieces to roll uninhibited across the entirety of said surface area of the top surface of the game wheel and roll into one of the plurality of receptacles within the annular collection area or land on the smooth top surface;

whereby in use, the plurality of disc shaped rollable playing pieces are released onto the smooth top surface of the game wheel and roll across the game wheel where they drop into one of the plurality of receptacles within the annular collection area or land on the smooth top surface;

wherein the rotating mechanism rotates the game wheel and the annular collection area that is operatively coupled with the rotating mechanism; and wherein the game wheel and the annular collection area are rotated in opposite angular directions and wherein the annular collection area is rotated at a lower speed than the game wheel.

14. A competitive game apparatus with spinning game wheel and playing pieces comprising:

a plurality of disc shaped rollable playing pieces having a first and an opposing second side;

an outer perimeter that is substantially circular in shape defining a disc-edge;

a base;

a game wheel rotatably connected to the base and comprising:

a circular top surface having a top surface area extending within a perimeter of the game wheel;

wherein the top surface is a flat surface and the top surface area consists of said flat surface the extends continuously across the top surface area within said perimeter of the circular top surface; and wherein the circular top surface is exposed to game players and configured to receive said plurality of disc shaped rollable playing pieces while said game wheel is rapidly spinning:

a bottom surface; and a lateral surface;

a rotating mechanism comprising:

a motor configured under the bottom surface of the game wheel and coupled with the game wheel to rapidly spin the game wheel at a constant speed during game play;

wherein the came wheel is rapidly spun with respect to said base that is stationary;

an annular collection area configured below and around an outer perimeter of the game wheel and comprising:

a first flange configured around and adjacent to the lateral surface of the game wheel;

a second flange offset radially from first flange; and a landing base configured between the first flange and the second flange;

a plurality of dividing walls that extend from the first flange to the second flange that create a plurality of receptacles;

wherein each of said plurality of receptacles defines a point weighted section;

a plurality of game scoring locations comprising:

said point weighted sections; and at least a Portion of the smooth top surface;

wherein said flat top surface extends continuously between the annular collection area thereby allowing the plurality of disc shaped rollable playing pieces to roll uninhibited across the entirety of said surface area of the top surface of the game wheel and roll into one of the plurality of receptacles within the annular collection area or land on the smooth top surface;

whereby in use, the plurality of disc shaped rollable playing pieces are released onto the smooth top surface of the game wheel and roll across the game wheel where they drop into one of the plurality of receptacles within the annular collection area or land on the smooth top surface;

wherein at least one of the plurality of disc shaped rollable playing pieces comprises a customizable accessory attached to one of said first or second sides for added weight and making said side heavier than the other side; and wherein said at least one of the plurality of disc shaped rollable playing pieces is configured to eccentrically move across the smooth top surface and into one of the plurality of annular collection areas.

15. A competitive game apparatus with spinning game wheel and playing pieces comprising:

a monitor device;

a plurality of disc shaped rollable playing pieces having a first and an opposing second side;

an outer perimeter that is substantially circular in shape defining a disc-edge; and a tracking device;

a base;

a game wheel rotatably connected to the base and comprising:

a circular top surface having a top surface area extending within a perimeter of the game wheel;

wherein the top surface is a flat surface and the top surface area consists of said flat surface the extends continuously across the top surface area within said perimeter of the circular top surface; and wherein the circular top surface is exposed to game players and configured to receive said plurality of disc shaded rollable playing pieces while said game wheel is rapidly spinning:

a bottom surface; and a lateral surface;

a rotating mechanism comprising:

a motor configured under the bottom surface of the game wheel and coupled with the game wheel to rapidly spin the game wheel at a constant speed during game play;

wherein the game wheel is rapidly spun with respect to said base that is stationary;

an annular collection area configured below and around an outer perimeter of the game wheel and comprising:

a first flange configured around and adjacent to the lateral surface of the game wheel;

a second flange offset radially from first flange; and a landing base configured between the first flange and the second flange;

a plurality of dividing walls that extend from the first flange to the second flange that create a plurality of receptacles;

wherein each of said plurality of receptacles defines a point weighted section;

a plurality of game scoring locations comprising:

said point weighted sections; and at least a portion of the smooth top surface;

wherein said flat top surface extends continuously between the annular collection area thereby allowing the Plurality of disc shaded rollable playing pieces to roll uninhibited across the entirety of said surface area of the top surface of the game wheel and roll into one of the plurality of receptacles within the annular collection area or land on the smooth top surface;

whereby in use, the plurality of disc shaped rollable playing pieces are released onto the smooth top surface of the game wheel and roll across the game wheel where they drop into one of the plurality of receptacles within the annular collection area or land on the smooth top surface; and whereby the monitoring device can determine which of the playing pieces was the last to roll off of the spinning game wheel and into a collection area.

* * * * *